US005108492A

United States Patent [19]

Kiyota et al.

[11] Patent Number: 5,108,492

[45] Date of Patent: Apr. 28, 1992

[54] CORROSION-RESISTANT SINTERED ALLOY STEELS AND METHOD FOR MAKING SAME

[75] Inventors: Yoshisato Kiyota; Hiroshi Ohtsubo; Junichi Ohta; Masakazu Matsushita; Ichio Sakurada, all of Chiba, Japan

[73] Assignee: Kawasaki Steel Corporation, Hyogo, Japan

[21] Appl. No.: 465,192

[22] PCT Filed: Jun. 27, 1989

[86] PCT No.: PCT/JP89/00633

§ 371 Date: Feb. 22, 1990

§ 102(e) Date: Feb. 22, 1990

[87] PCT Pub. No.: WO90/00207

PCT Pub. Date: Jan. 11, 1990

[30] Foreign Application Priority Data

| | | | |
|---|---|---|---|
| Jun. 27, 1988 | [JP] | Japan | 63-156841 |
| Aug. 20, 1988 | [JP] | Japan | 63-206717 |
| Aug. 20, 1988 | [JP] | Japan | 63-206718 |
| Aug. 21, 1988 | [JP] | Japan | 63-206563 |

[51] Int. Cl.[5] ..... B22F 9/00

[52] U.S. Cl. ..... 75/246; 419/25; 419/56; 419/57; 419/54

[58] Field of Search ..... 75/246; 419/23, 36, 419/37, 54, 57

[56] References Cited

U.S. PATENT DOCUMENTS

| | | | |
|---|---|---|---|
| 4,240,831 | 12/1980 | Ro et al. | 75/246 |
| 4,314,849 | 2/1982 | Ro et al. | 75/228 |
| 4,415,528 | 11/1983 | Wiech, Jr. | 419/46 |
| 4,420,336 | 12/1983 | Klar et al. | 75/246 |
| 4,552,719 | 11/1985 | Morimoto et al. | 419/54 |
| 4,581,202 | 4/1986 | Kudo et al. | 75/246 |
| 4,591,482 | 5/1986 | Nyce | 419/38 |
| 4,770,703 | 9/1988 | Tarutani et al. | 75/246 |
| 4,828,630 | 5/1989 | Daniels et al. | 75/246 |
| 4,891,080 | 1/1990 | Del Corso et al. | 75/246 |
| 4,937,041 | 6/1990 | Deffeyes | 75/246 |

FOREIGN PATENT DOCUMENTS

| | | |
|---|---|---|
| 0038558 | 10/1981 | European Pat. Off. . |
| 49-750496 | 7/1974 | Japan . |
| 61-253349 | 11/1986 | Japan . |

OTHER PUBLICATIONS

"Treatise on Powder Metallurgy", by Claus G. Goetzel, Ph.D., vol. I, Technology of Metal Powders and Their Products, 1949, pp. 627-633.

"Brazing in Controlled Atmospheres and in Vacuo", by E. V. Beatson, British Welding Journal, pp. 137-143, Apr. 1958.

"An Emerging Manufacturing Technology that Combines Powder Metallurgy and Plastic Molding Methods Offers New Economies and Design Opportunities for Small, Complex Metal Parts", by J. Robert Merhar, Machine Design, vol. 56, No. 18, Aug. 9, 1984, pp. 85-87.

*Primary Examiner*—Stephen J. Lechert, Jr.

*Attorney, Agent, or Firm*—Austin R. Miller

[57] ABSTRACT

It is provided a method for the manufacture of a corrosion-resistant sintered alloy steel, which comprises providing a stainless steel powder; adding a binder to said steel powder; molding the mixture; and carrying out the steps of (1) heating the resultant molding to remove the binder therefrom, (2) sintering the thus debound molding under reduced pressure up to 30 Torr, and (3) further sintering at a higher temperature than those of steps (1) and (2) in a non-oxidative atmosphere under substantially atmospheric pressure. It is also provided a corrosion-resistant sintered alloy steel which comprises a stainless steel, said alloy steel having a density ratio of not less than 92%, a maximum diametric of pore present in the structure of not larger than 20 μm, and a content of Cr at the surface of the steel as being sintered which is not less than 80% of a content of Cr in the inside thereof.

12 Claims, 1 Drawing Sheet

CORROSION-RESISTANT SINTERED ALLOY STEELS AND METHOD FOR MAKING SAME

FIELD OF THE INVENTION

This invention relates to corrosion-resistant sintered alloy steels which are made by powder metallurgy and also to a method for making such steels.

PRIOR ART

In recent years, the manufacture of sintered parts by powder metallurgy has been remarkably developed and the field of application of the sintered parts has now been extending. In particular, automobile parts, electronic and electric parts and office parts become more complicated in shape and their manufacturing technique is now undergoing a change from the machine work to powder metallurgy.

However, sintered alloys produced by the powder metallurgy are disadvantageous in that voids or pores are present in the alloy and give an adverse influence on corrosion resistance and mechanical characteristics. To avoid this, the sintered alloy should have a density as high as possible with a density ratio of not less than 92% being required.

For the manufacture of sintered parts by powder metallurgy, if known press molding is used wherein starting powders have a size as large as several tens to 150 micrometers, the density ratio attained by the molding and sintering is in the range of 80 to 90%. Thus, a satisfactory high density could not be obtained. Since the starting material is in the form of a coarse powder or grain, the space between particles is great and voids having a size of not less than 50 micrometers are present. The voids are not reduced nor disappear during the sintering, but remain in the structure of the resultant sintered product. The presence of the void leads to considerable deterioration of the corrosion resistance.

In order to improve the corrosion resistance, sintered alloys of high density have been developed wherein other alloy elements are added to stainless steel powder to cause a liquid phase to appear.

For instance, as described in Japanese Laid-Open Patent Application No. 58-213859, there is known a sintering material in which Co or B is added to and dispersed in a matrix so that during sintering, a liquid phase containing Co or B is produced to fill the voids or pores therewith. In Japanese Laid-Open Patent Application No. 61-253349, there is proposed a sintered stainless steel of high density wherein P is added so as to cause a liquid phase to appear.

However, if Co metal which is an expensive powder is added, the product cost rises with a sacrifice of economy which is one of merits involved in powder metallurgy.

When P is added, the liquid phase portion occluding P as a solid solution is left, after cooling, as a brittle phase, resulting in deterioration of mechanical characteristics.

Accordingly, the high densification technique wherein alloy elements are added and high density is attained by the liquid phase sintering has to be avoided. Further, in order to reduce residual pores, which directly influence the corrosion resistance, to an extent as low as possible, there is known a method wherein sintering materials are subjected to re-compression or re-sintering, or also to hot forging or hot isostatic treatment. This presents the problem that the procedure becomes complicated with the need of a specific type of device and complicated working operations.

Since stainless steels contains Cr which is a hard-to-reduce element, the dew point should be at a level not higher than −50° C. for sintering in a reductive atmosphere. This is difficult from the industrial viewpoint and the common practice is to sinter in vacuum as is well known in the art. When the sintering is effected in vacuum, the Cr element having a high vapor pressure evaporates from the surface which is exposed in vacuum. This will lower the Cr concentration at the surface of sintered product, thus leading to considerable deterioration of the corrosion resistance at the surface. This has been experimentally confirmed by us. From this, it is assumed that the sintered product of high density obtained by the known vacuum sintering is a sintered alloy whose corrosion resistance is poor.

DISCLOSURE OF THE INVENTION

An object of the invention is to provide a sintered alloy steel and a method for making the steel which has a density ratio of not less than 92% and has a uniform concentration of alloy components with a good corrosion resistance without addition of any alloy steel powder other than stainless steel powder components, without the step of re-compression or re-sintering and without resorting to any specific device.

Another object of the invention is to provide a corrosion-resistant stainless steel sintered product which has such characteristics as mentioned above and wherein the lowering in concentration of Cr at the surface of the sintered product can be suppressed.

According to the invention, there is provided a corrosion-resistant sintered alloy steel which has a stainless steel composition, a density ratio of not less than 92%, a maximum diameter of pore present in the structure of not larger than 20 μm, and a Cr content at the surface of the sintered product as being sintered which is not less than 80% of a Cr content in the inside of the sintered product.

There is also provided a method for making a corrosion-resistant sintered alloy steel which comprises providing a stainless steel powder, adding a binder to the steel powder, molding the mixture, heating the resultant green molding to remove the binder, sintering the debound molding under a reduced pressure of not higher than 30 Torr, and further sintering the molding in a non-oxidative atmosphere.

DESCRIPTION OF THE PREFERRED EMBODIMENT

Figure 1:
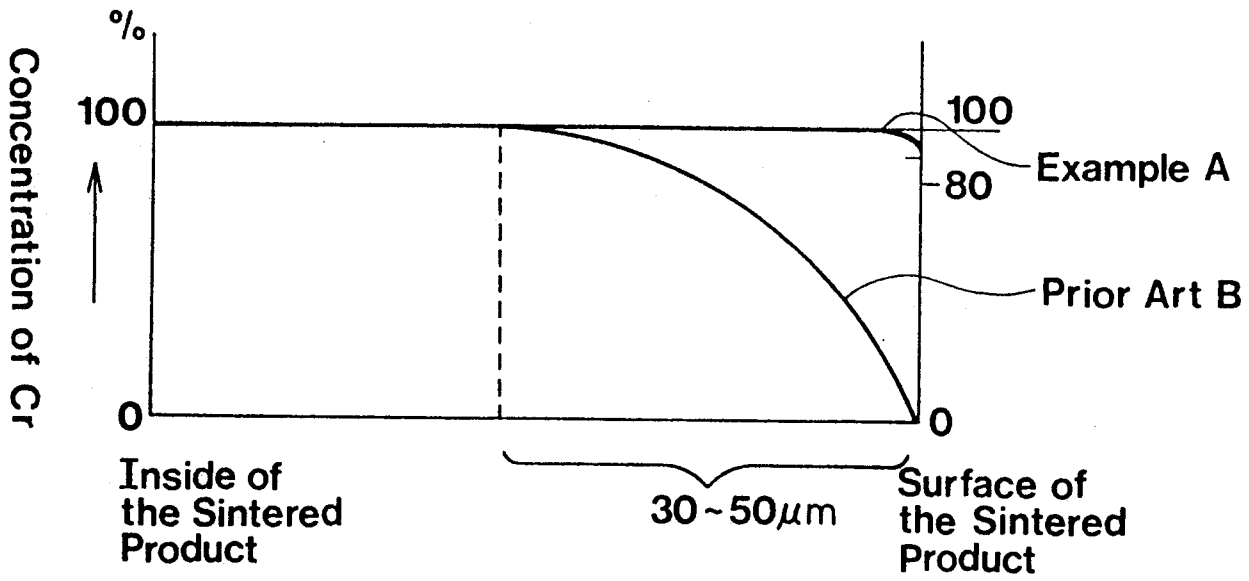
FIGURE 1 is a graph showing the results of EPMA line analysis for the Cr concentration in the vicinity of the surface of a sintered product.

The corrosion-resistant sintered alloy steel of the present invention has a stainless steel composition, a density ratio of not less than 92%, a maximum diameter of pore present in the structure of not larger than 20 μm, and Cr content at the surface of the sintered product which is not less than 80% of a Cr content in the inside of the sintered product as being sintered, that is, without any treatment such as heating after the sintering.

The present invention provides a sintered alloy steel having a so-called stainless steel composition and the sintered alloy steel is defined to have the following characteristics.

The sintered density ratio is a factor which directly influences the corrosion resistance. With a sintered product having a density ratio less than 92%, residual pores are not completely filled, so that it is assumed that pores in the surface layer and inside of the product are partially associated with one another. Accordingly, the inside is invariably exposed to an exterior severe corrosion environment, making an unsatisfactory corrosion resistance. Further, if the ratio is less than 92%, the diameter of residual pore becomes large, giving an adverse influence on the corrosion resistance. Accordingly, the lower limit of the density ratio should be 92%.

The corrosion resistance of stainless steel is based on the passive state forming a protective oxide film. A phenomenon where this film is broken and corrosion takes place at the broken portion is called pitting corrosion. It is considered that pores are liable to be a source for the generation of pitting corrosion. The size of pore is an important factor which determines whether a pit is again passivated or it starts to grow. If the maximum diameter of pore exceeds 20 μm, the passive film is not readily restored but etch pits start to grow violently, thus producing pitting corrosion. This is why the maximum diameter of pore is determined as 20 μm. It will be noted that the maximum diameter of pore used herein means Dmax which is calculated according to the following equation:

$$Dmax = 2 \times \sqrt{Smax/\pi}$$

wherein Smax: a sectional area of a pore having a maximum sectional area among pores.

The sintered alloy steel of the invention is characterized in that the Cr content at the surface and the Cr content in the inside are uniform as being sintered. The curve A in FIG. 1 shows the results of the EPMA line analysis with respect to the concentration of Cr along the section in the vicinity of the surface of a sintered alloy steel made in Example 1. Since Cr has a high vapor pressure, it evaporates in vacuum for conventional sintered alloy steels which are sintered in vacuum. As a result, the Cr concentration in the vicinity of the surface lowers considerably by approximately 10% relative to the Cr concentration in the inside as is particularly shown in curve B. This results in poor corrosion resistance at the surface. In contrast, the alloy steel of the invention has little variation in the Cr concentration at the surface and the inside as shown in curve A and has thus a uniform Cr concentration.

We have confirmed that, with an alloy steel in the state of being sintered without any heat treatment after sintering, no corrosion problem arises when the Cr concentration at the surface of sintered product is not less than 80% based on the Cr concentration in the inside. Accordingly, an index to the uniformity in the concentration is defined to be not less than 80%.

A preferable method for the manufacture of the sintered alloy steel according to the invention comprises providing a stainless steel powder, molding the powder without adding a binder, heating the molding under reduced pressure, and further sintering in a non-oxidative atmosphere. The other preferable method for the manufacture of the sintered alloy steel according to the invention comprises providing a stainless steel powder, adding a binder to the steel powder, molding the mixture, heating the resultant green body to remove the binder, sintering the body under reduced pressure, and further sintering in a non-oxidative atmosphere.

In the method of the present invention, the binder need not always to be added, but preferably, an organic binder may be used. In the practice of the invention, an injection molding method is preferably adopted since it enables one to obtain a product of any complicated form. The two-stage sintering treatment under properly selected, different conditions ensure the economical manufacture of a sintered product which has a high density, a good corrosion resistance and good mechanical characteristics.

Preferably, the stainless steel powder should have an average particle size of not larger than 15 μm. When the stainless steel powder provided as a starting powder and having an average particle size of not larger than 15 μm is molded and sintered in vacuum and then in a non-oxidative atmosphere, the concentration distribution of alloy elements, particularly Cr component, can be uniform and the diameter of residual pores in the sintered product and the porosity can be suppressed to a minimum. In addition, the quantity of impurities can also be suppressed to a minimum. This leads to a sintered alloy having a good corrosion resistance.

Preferably, the debinding step of the binder by heating the green body should be effected in a non-oxidative atmosphere.

The features of the invention have been described above but other manufacturing conditions may be further added in the practice of the invention provided that the above featuring requirements are satisfied.

[1] The corrosion-resistant sintered alloy steel of the invention has a composition which comprises:

| | |
|---|---|
| Cr: | 16 to 25 wt % |
| Ni: | 8 to 24 wt % |
| C: | ≦0.06 wt % |
| O: | ≦0.7 wt % |

with the balance of Fe and inevitable impurities, and has a density ratio of not less than 92%, a maximum diameter of pore present in the structure of not larger than 20 μm, and, a Cr content at the surface of the sintered product as being sintered, which is not less than 80% of a Cr content in the inside of the sintered product.

Aside from the above components, the sintered alloy steel may further comprise Mo≦10 wt %. This steel has better resistances to corrosion and oxidation and good mechanical characteristics.

The composition of the sintered alloy steel of the present invention is described in more detail.

The sintered alloy steel composition of the invention should comprise Cr, Ni, C, O with or without Mo. These elements are important elements which influence the corrosion resistance.

At a higher content of Cr, the corrosion resistance is more improved. If the content is less than 16 wt %, a good corrosion resistance as intended cannot be obtained. On the other hand, over 25 wt %, a better effect cannot be recognized with economy. Moreover, a problem arises with respect to sigma brittleness and brittleness at 475° C., so that the upper limit is determined as 25 wt %.

Ni is an element which advantageously stabilizes the austenite phase and can improve the corrosion resistance and mechanical characteristics such as tenacity. However, if the content is less than 8 wt %, the capability of formation of a stable austenite phase is poor with deterioration of the corrosion resistance. Ni content of 8 wt % or over is necessary. On the other hand, when the content exceeds 24 wt %, a more appreciable effect is not obtained. In view of economy, the upper limit is determined as 24 wt %.

Mo is an element which is the most effective in improving the resistances to corrosion and oxidation and is advantageous in improving mechanical characteristics by formation of solid solution in steel matrix. However, when its content exceeds 10 wt %, problems of sigma brittleness and 475° C. brittleness arise and the upper limit is determined as 10 wt %, accordingly.

It is well known that a lower content of C leads to a more improvement in the corrosion resistance. The reason why the upper limit is determined as 0.06 wt % is as follows: over this limit, a liquid phase appears, so that pores become larger in size, and carbides of Fe and Cr are produced with the appearance of a region of a low Cr content, resulting in poor corrosion resistance.

At a lower content of O, densification proceeds more easily with a higher sintered density, so that the corrosion resistance is improved. However, when the content of O exceeds 0.3 wt %, Cr oxides are produced to impede the sintering. Thus, a high density cannot be obtained with a poor corrosion resistance.

If the lowering in density caused by the presence of the Cr oxides is not considerable, the corrosion resistance does not deteriorate in an extreme case with an increase in content of O. Accordingly, a necessary level of the corrosion resistance depending upon the purpose will be ensured.

The reduction in amount of C and O in the sintered product proceeds in the following manner:

$$C+O \rightarrow CO \text{ or } C+2O \rightarrow CO_2$$

The reaction rate is proportional to the product of the contents by wt % of C and O. The reaction time necessary for reducing, to below 0.06 wt %, the content of C which causes the corrosion resistance to deteriorate considerably can be shortened by increasing a tolerance value of the O content in a final sintered product. If a required level of the corrosion resistance is not so high, the content of O should preferably exceed 0.3% from the economical viewpoint. However, over 0.7 wt %, the corrosion resistance deteriorates considerably and thus, the upper limit of the O content is determined as 0.7 wt %.

As described before, the sintered density ratio should be over 92%, inclusive, the maximum diameter of pore should be not larger than 20 μm, and the Cr content in the surface layer of sintered product as being sintered should be not less than 80% of the Cr content in the inside of sintered product. The reasons for these definitions are as set forth before.

The method of the manufacture of sintered alloy steel comprises:

providing a steel powder which comprises:

Cr: 16 to 25 wt %

Ni: 8 to 24 wt % and which has an average particle size of not larger than 15 μm;

adding a binder to the steel powder;

molding the mixture;

heating the resultant green body in a non-oxidative atmosphere to remove the binder from the body;

sintering the thus debound body at a temperature of from 1000° to 1350° C. under a reduced pressure of not higher than 30 Torr; and further sintering in a non-oxidative atmosphere at a temperature of 1200° to 1350° C.

If a steel powder containing Mo≦10 wt % is used as the starting powder, a sintered alloy steel having better characteristics can be obtained.

In the method of the invention, the contents of Cr and Ni are defined within certain ranges, respectively. This is necessary for obtaining the above sintered alloy steel.

The average size of the steel powder is one of factors which influences the density ratio of sintered product. A smaller average particle size results in a higher density ratio. When a steel powder having an average particle size over 15 μm is used, a density ratio not less than 92% cannot be achieved. Voids or interstices among particles produced during the sintering become larger in size and the maximum diameter of residual pores exceeds 20 μm. Thus, a desired level of corrosion resistance cannot be obtained. The average particle size of the steel powder should be not larger than 15 μm.

The steel powder should preferably be substantially in the form of spheres which are free of extreme irregularities on the surface. If the powder is not substantially spherical in shape, e.g. in the form of flakes or rod-like particles, the resultant molding is imparted with anisotropy. When a part of complicated shape is formed, dimensional shrinkage is beyond expectation to obtain the part with a desired shape. Moreover, if the powder is sharp or angular, additional binder unfavorably becomes necessary.

Extreme recesses of the particles will give additional spaces to sintered product and extreme protrusions of the particles will impede smooth contact between particles. In either case, additional binders become necessary as compared with the case using spherical particles aside from the above drawbacks. Thus, such particles are not favorable.

The steel powder used in the present invention should have an average particle size of not larger than 15 μm and should preferably be substantially spherical or round in shape without involving extreme irregularities on the surface. Such a steel powder is obtained by an atomizing method and is preferably one which is obtained by a high pressure water atomizing method.

In the method of the invention, the steel powder is at first molded. Since the powder is fine with an average particle size of not larger than 15 μm, defects such as lamination, cracks and the like will be produced during the molding when using the steel powder alone. In order to suppress the defects, binders are added, after which the molding is performed. The binder may be thermoplastic resins, waxes, plasticizers, lubricants and debinding promoters.

Examples of the thermoplastic resins include acrylic resins, polyethylene, polypropylene and polystyrene. Examples of the waxes include natural waxes typical of which are bees wax, Japan wax and montan wax, and synthetic waxes typical of which are low molecular weight polyethylene, microcrystalline wax, paraffin wax and the like. One or more of these materials are used.

The plasticizers are selected depending upon the type of resin or wax used as the main ingredient. Specific examples include dioctyl phthalate (DOP), di-ethyl phthalate (DEP), di-n-butyl phthalate (DBP), diheptyl phthalate (DHP) and the like.

The lubricants may be higher fatty acids, fatty acid amides, fatty acid esters and the like. In some case, waxes may also be used as the lubricant.

The debinding promoters may be sublimable substances such as camphor.

The amount of the binder may vary depending on the manner of molding in the subsequent steps. The binder mainly consisted of lubricants is generally in the range of from 0.5 to 3.0 wt % to the weight of steel powder for press molding and the binder mainly consisted of thermoplastic resins and/or waxes is approximately 10 wt % to the weight of steel powder for injection molding.

The blending or kneading of the steel powder and binder may be carried out by a batch-type or continuous kneader. Preferably, a pressure kneader or a Banbury mixer is used as the batchwise kneader and a biaxial extruder is used as the continuous kneader. After the kneading, the mixture is granulated by the use of a pelletizer or crasher, if necessary, thereby obtaining a molding compound.

The starting material for press molding may be obtained by the V-type or double cone-type mixer.

The molding may be performed by various molding methods including press molding, extrusion molding, powder roll molding, injection molding and the like, of which the injection molding is preferred.

The injection molding is carried out using ordinary injection molding machines such as an injection molding machine for plastics, an injection molding machine for metallic powder and the like. The injection pressure is generally in the range of from 500 to 2000 kg/cm$^2$.

After completion of the molding, the binder is removed by heating in a non-oxidative atmosphere. The heating rate is in the range of from 5° to 300° C./hour and the molding is kept at 450° to 700° C. for 0 to 4 hours and then cooled. If the heating rate is too high, the resultant molding may be unfavorably cracked or swollen.

The molding from which the binder has been removed is sintered to obtain a sintered product of the present invention.

If necessary, the contents of C and O in the final sintered product may be regulated at 0.3 to 3 of C/O ratio. For the increase or decrease in amount of C and/or O, the ratio of C/O in the debound product, e.g. when the C/O ratio decreases, the content of C can be reduced and when the C/O ratio increases, the content of O can be reduced. The C/O ratio can be controlled by controlling the amounts of C and O in the starting powder, by controlling the removal in amount of the binder or by oxidation treatment after the debinding. The reduction of the total levels of C and O (corresponding to the product of the amounts of C and O) can be attained by lowering the pressure and by increasing the sintering time in the course of the reduced pressure sintering.

After the removal of the binder, sintering is effected.

Sintering conditions should be determined considering the following phenomena which are: (1) the reduction-decarburization simultaneous reaction based on the direct reaction between C and O contained in a molding product to be sintered (which is an injection molding or press molding product from which organic binder has been removed); (2) the lowering in concentration of Cr at the surface of the sintered product due to the evaporation of Cr element; and (3) the densification by sintering due to the mutual diffusion of powder constituent atoms.

The sintering of the present invention is constituted two stages. The primary feature of the first stage resides in that the reduction and decarburization simultaneous reaction is promoted and the evaporation of Cr is suppressed. The primary feature of the second stage resides in that the lowering in concentration of Cr which will inevitably occur in the surface portion during the first stage is restored and in that the densification by sintering is promoted.

The first-stage sintering is effected by heating at a temperature of from 1000° to 1350° C. at a reduced pressure of not larger than 30 Torr.

Reduction and decarburization reaction can be also effected by heating in hydrogen gas atmosphere. However, it is not economical to heat the stainless steel of the present invention in hydrogen because the composition containing considerable Cr, which is a hard-to-reduce element, is needed a large amount of high purity hydrogen gases. On the other hand, heated at a reduced pressure of not larger than 30 Torr according to this invention, the reduction-decarburization simultaneous reaction in which the carbon and oxygen contained in the molding reacts directly, enabling economical and effective operation.

From the standpoint of chemical equilibrium, the reduction and decarburization simultaneous reaction more proceeds at higher temperatures under a lower pressure. At the same time, the lowering in concentration of Cr in the surface portion of Cr is more facilitated. On the other hand, from the standpoint of chemical kinetics, the reduction and decarburization simultaneous reaction is controlled by the diffusion of CO gas which is one of the reaction products. The lowering in concentration of Cr in the surface portion of sintered product is controlled by the atomic diffusion of inside of the sintered product. As the sintering proceeds, the passages of gases in the inside of the sintered product are intercepted with a considerable lowering of the diffusion rate of CO gas, giving only a little influence on the diffusion rate of Cr. This has been experimentally confirmed.

The first-stage sintering is effected by heating at a temperature of from 1000° to 1350° C. At temperatures lower than 1000° C., the reduction and decarburization simultaneous reaction does occur from the standpoint of thermal equilibrium, but the reaction rate is low with spending much time to obtain sintered products having low contents of C and O. Accordingly, the first-stage sintering temperature is preferably at least 1000° C.

On the other hand, over 1350° C., the densification by sintering quickly proceeds with a considerable lowering of the diffusion rate of CO gas, so that the reduction and decarburization simultaneous reaction does not proceed efficiently and a sintered product having low contents of C and O cannot be obtained. Moreover, both the Cr vapor pressure and the Cr diffusion rate are so high that the concentration of Cr from the surface of sintered product to a deep region lowers appreciably. Accordingly, the upper temperature of the first-stage sintering should be 1350° C.

It will be noted that the temperature at which the densification by sintering proceeds faster differs depending upon the size of the starting powder. A lower temperature may be selected for a smaller average size and a higher temperature may be selected for a larger average size, but within the above-defined range.

The first-stage sintering is effected under reduced pressure up to 0.1 Torr when evacuating alone in the vacuum heating furnace is operated with a vacuum pump without introduction of any gas from outside. When the introduction of a non-oxidative gas from outside and the evacuation with a vacuum pump in a vacuum heating furnace are both used, the first-stage sintering is effected under reduced pressure up to 30 Torr. The pressures over 0.1 Torr in the former case and over 30 Torr in the latter case cause the reduction and decarburization simultaneous reaction of Cr oxides to be unlikely to proceed efficiently. Thus, this condition is not preferable.

This is described in more detail. The reduction reaction of the Cr oxides is controlled by the total partial pressure (hereinafter referred to as product gas pressure) of CO and $CO_2$ gases which are the reaction products. Accordingly, it is essential that the product gas be discharged out of the reaction system (sintering furnace) so as to keep the product gas pressure at a level less than the oxidation/reduction equilibrium pressure. Methods of satisfying the above requirement include a method using vacuum conditions, a method using highly pure non-oxidative gases such as Ar, $N_2$, $H_2$ and the like, and the combination of the above methods. The first case is carried out using a vacuum sintering furnace which is a heating furnace having such a high tightness that the product gas pressure is substantially equal to the total pressure in the sintering furnace and which has a vacuum pump having an exhaust velocity sufficient to keep the total pressure in the furnace of not larger than 0.1 Torr. In the second case, the furnace pressure is in an atmospheric range. In order to keep the product gas pressure at a level of not larger than 0.1 Torr, a fresh gas having high purity which is free of any product gas should be at a level of not less than 759.9 Torr when calculated in a simple model. However, supply of a non-oxidative gas in an amount of about 10,000 times that of the product gas at the time of the reaction is industrially impossible. The third case is a method of introducing a fresh, highly pure non-oxidative gas free of any product gas through a pressure control valve into the vacuum sintering furnace, which is shown in the first case. It is considered that this method is, more or less, effective in suppressing the evaporation of Cr upon heating. The total pressure in the furnace should preferably be not larger than 30 Torr. In this method, the total pressure in the furnace is represented by the sum of the product gas pressure and the introduced non-oxidative gas pressure. When the exhaust velocity of the vacuum pump is constant, the exhaust velocity of the product gas to outside of the heating furnace becomes constant irrespective of the introduction gas. However, when the total pressure in the furnace exceeds 30 Torr, the exhaust velocity of the vacuum pump lowers abruptly (especially used in combination with a mechanical booster and an oil rotary pump) and the release speed of the product gas from the surface of the sintered product lowers, so that the exhaust velocity of the product gas lowers with a lowering of the reduction reaction rate. This is the reason why the upper limit of the total pressure in the furnace is determined as 30 Torr.

As described above, the reduction reaction of Cr oxides can be readily promoted by means of the carbon containing. For this purpose, the C/O molar ratio in the molding prior to the sintering should be appropriately controlled. This is because the reduction in amount of C and O in the sintered product proceeds in the following manner:

$$C+O \rightarrow CO$$

$$C+2O \rightarrow CO_2$$

If the C/O molar ratio is inappropriate, the sintered product is in excess of C or O and the following requirements cannot be attained:

$$C \leqq 0.06 \text{ wt } \%$$

$$O \leqq 0.7 \text{ wt } \%.$$

When the lower limit of the C/O molar ratio is less than 0.3, the content of O in the sintered product exceeds 0.3 wt % and the sintered density is not increased. On the other hand, when the C/O molar ratio is over 3.0, the content of C in the sintered product exceeds 0.06 wt %, which leads to formation of a liquid phase. This entails coarseness of pores and deterioration of corrosion resistance with a difficulty in keeping the shape. The C/O molar ratio in the molding prior to the sintering is defined in the range of from 0.3 to 3.0.

Subsequently, in order to achieve the high densification and uniformalization of the alloy elements by diffusion, the molding is sintered in the second stage in a non-oxidative atmosphere at a temperature of from 1200° to 1350° C. The reason why the non-oxidative atmosphere is used is to suppress the evaporation of Cr. The gas for the non-oxidative atmosphere includes, for example, an inert gas such as Ar, He, $N_2$ and the like, a reducing gas such as $H_2$, CO, $CH_4$, $C_3H_8$ and the like, and a combustion exhaust gas. The pressure of these gases should be far higher than the vapor pressure of Cr, and the flow rate in the heating furnace should be kept at nearly zero, so that the evaporation of Cr at the surface of sintered product can be controlled more effectively. Consequently, the diffusion of Cr proceeds as being sintered because the concentration gradient of Cr from the inside of sintered product toward the product surface which has been inevitably formed during the first-stage sintering works as the driving force. Thus, there can be obtained the sintered alloy steel of the invention whose Cr concentration at the surface is restored to not less than 80% of the Cr concentration in the inside as being sintered.

It should be noted that we have experimentally confirmed that when the sintering temperature is kept constant in the first and second stages of the sintering (corresponding to a constant diffusion rate of Cr), it takes a longer time for the restoration of the region of a lower Cr content at the surface than in the case of the formation of such a region. Accordingly, in order to effectively restore the lower Cr region at the surface within a short time, the sintering temperature used in the second stage should be higher than the sintering temperature in the first stage. Moreover, for ensuring the densification by sintering and progress of fineness and spherization of remaining pores after the sintering, the sintering temperature should be higher than in the first stage.

At temperature lower than 1200° C., the restoration of the lower Cr region cannot be made effectively and a sintered product obtained is unsatisfactory with respect to the densification by sintering (i.e. low density). This is the reason why the second-stage sintering temperature is preferably at least 1200° C.

On the other hand, over 1350° C., the liquid phase appears with the shape being not retained and with a brittle phase being left with a lowering of strength. Accordingly, the sintering temperature of the second-stage is preferably up to 1350° C.

[2] The corrosion-resistant sintered alloy steel of the invention having a high nitrogen content has a composition which comprises:

| | |
|---|---|
| Cr: | 16 to 25 wt % |
| Ni: | 6 to 20 wt % |
| C: | ≦0.05 wt % |
| N: | 0.05 to 0.40 wt % |

with the balance of Fe and inevitable impurities.

Other corrosion-resistant sintered alloy steel of the invention having a high nitrogen content has the following composition:

| | |
|---|---|
| Cr: | 16 to 25 wt % |
| Ni: | 6 to 20 wt % |
| C: | ≦0.05 wt % |
| N: | 0.05 to 0.40 wt % |
| Mo: | 0.5 to 4.0 wt % |

with the balance of Fe and inevitable impurities.

The corrosion-resistant sintered alloy steel composition of the invention having a high nitrogen content comprises Cr, Ni, C, and N with or without Mo. These elements are important elements which influence the corrosion resistance. The amounts of the respective elements are defined for the following reasons.

Cr: At a higher content of Cr, the corrosion resistance is more improved. If the content is less than 16 wt %, a desired corrosion resistance cannot be obtained. On the other hand, over 25 wt %, a better effect cannot be recognized with poor economy. Moreover, the higher Cr content involves the problem with respect to sigma brittleness and brittleness at 475° C.

Ni: Ni is an element which advantageously stabilizes the austenite phase. When the austenite phase is stabilized, the corrosion resistance and mechanical characteristics such as tenacity are improved. However, if the content is less than 6 wt %, the capability of formation of a stable austenite phase is poor with deterioration of the corrosion resistance. On the other hand, when the content exceeds 20 wt %, a more appreciable effect is not obtained with poor economy.

C: a lower content of C leads to a more improvement in the corrosion resistance. When the content exceeds 0.05 wt %, a liquid phase appears, so that pores become larger in size, and carbides of Fe and Cr are produced with the appearance of a region of a low Cr content, resulting in poor corrosion resistance.

N: N is an element which remarkably improves a pitting corrosion resistance of sintered product having pores. If the content is less than 0.05 wt %, such an effect is small. On the other hand, over 0.4 wt %, Cr nitrides are produced with a region of a low Cr content, resulting in the poor corrosion resistance.

Mo: Mo is an element which is effective in improving the resistances to corrosion and oxidation. If the content is less than 0.5 wt %, such an improving effect is not produced. Over 4 wt %, a more appreciable effect is not recognized and is not thus advantageous in economy.

As described above, Mo is a metal which is effective in improving the resistances to corrosion and oxidation, so that stainless steel sintered products of high nitrogen content comprising Mo are more improved in the corrosion and oxidation resistances.

As for O content, there is no need for specific limitation. Considering a treatment after the sintering, O content is preferably up to 0.7 wt %.

The high nitrogen content, sintered alloy steel of the invention has a density ratio of not less than 92% and a maximum diameter of pore present in the structure of not larger than 20 μm.

The reason for this is similar to that set out with respect to other sintered alloy steels of the invention.

The method for manufacturing the corrosion-resistant sintered alloy steel with a high nitrogen content is described.

A preferable method of manufacturing the sintered alloy steel with a high nitrogen content is a method which follows.

The method comprises providing a stainless steel powder which comprises 16 to 25 wt % of Cr, 6 to 20 wt % of Ni and which has an average particle size of not larger than 15 μm or a stainless steel powder which comprises 16 to 25 wt % of Cr, 6 to 20 wt % of Ni and 0.5 to 4.0 wt % of Mo and which has an average particle size of not larger than 15 μm, adding a binder to the steel powder and molding the mixture, heating the resultant green body in a non-oxidative atmosphere to remove the binder from the body, sintering the thus debound body at a temperature of from 1000° to 1350° C. under a reduced pressure of not higher than 30 Torr, and further sintering in an inert mixed gas atmosphere containing $N_2$ at a temperature of 1200° to 1400° C.

In the latter case where the steel powder containing from 0.5 to 40 wt % of Mo as the starting material, the sintered product obtained has better characteristics.

In the method of the invention, the contents of Cr and Ni are defined within certain ranges, respectively. This is necessary for obtaining the above sintered alloy steel.

The average size of the steel powder is defined in the range of not larger than 15 μm and the reason for this has already been stated in [1].

Then, a binder is added to the starting material, the resultant mixture is molded, and the resultant green body is debound, and then, the resultant debound body is sintered. The addition of the binder, molding and debinding have been described in [1].

The sintering of the invention is constituted of two stages. The primary feature of the first stage resides in that the reduction and decarburization simultaneous reaction between oxides and occluded carbon which are contained in the debound body is promoted and the evaporation of Cr is suppressed. The primary feature of the second stage resides in that the lowering in concentration of Cr which will inevitably occur in the surface portion during the first stage is restored, the densification by sintering is promoted, and the sintered body is nitrified.

The first-stage sintering is effected in the manner as stated in [1], by heating at a temperature of from 1000° to 1350° C. at a reduced pressure of not larger than 30 Torr.

At a temperature lower than 1000° C., the rate of reduction and decarburization simultaneous reaction is slow with costing much time to obtain sintered products having low contents of C and O. on the other hand, over 1350° C., evaporation of Cr becomes high. Therefore, the first-stage sintering is preferably effected by heating at a temperature of from 1000° to 1350° C.

The sintering over 0.1 Torr, in the case of heating in the vacuum heating furnace by means of a vacuum pump alone without introduction of any gas from outside, and the sintering over 30 Torr, in the case of heating in which both the introduction of a non-oxidative gas from outside and the evacuation with a vacuum pump are used, are unlikely to promote the reduction and decarburization simultaneous reaction of Cr oxides effectively. Preferred reduced pressure is up to 0.1 Torr in the former case, and up to 30 Torr in the latter case.

The second-stage sintering is effected at a temperature of 1200° to 1400° C. in a non-oxidative inert mixed gas atmosphere containing $N_2$. By this, a high nitrogen content, high density and uniformity in the distribution of Cr concentration are achieved.

At temperatures lower than 1200° C., the density ratio of the sintered product is not improved remarkably and the Cr at the surface of the steel powder which is reduced by evaporation during the preceding sintering under reduced pressure cannot be supplemented by diffusion from the inside. On the other hand, over 1400° C., partial fusion takes place with the shape being not retained and thus, a product of a desired shape cannot be obtained. Accordingly, the sintering temperature is preferably in the range of from 1200° to 1400° C.

This step is carried out in an inert mixed gas atmosphere containing $N_2$ and the content of $N_2$ in the mixed gas should preferably be in the range of from 10 to 90% by volume.

If the content is less than 10% by volume, the high nitrification of the sintered product is rarely achieved and thus, a resistance to pitting corrosion cannot be attained satisfactorily. Over 90% by volume, nitrogen is contained in large amounts, leading to the formation of Cr nitrides. This causes regions of a low Cr content to be formed, resulting in deterioration of the corrosion resistance.

[3] The corrosion-resistant sintered alloy steel of the invention has a composition which comprises:

| | |
|---|---|
| Cr: | 18 to 28 wt % |
| Ni: | 4 to 12 wt % |
| C: | ≦0.06 wt % |
| O: | ≦0.7 wt % |

with the balance of Fe and inevitable impurities, and which has a density ratio of not less than 92%, a maximum diameter of pore present in the structure of not larger than 20 μm, and Cr content at the surface of the sintered product as being sintered which is not less than 80% of a Cr content in the inside of the sintered product.

Other corrosion-resistant sintered alloy steels of the invention comprise, aside from the above components of Cr, Ni, C and O, from 0.5 to 4.0 wt % of Mo and/or from 0.05 to 0.3 wt % of N with the balance of Fe and inevitable impurities, and have a density ratio of not less than 92%, a maximum diameter of pore present in the structure of not larger than 20 μm, and a Cr content at the surface of the sintered product as being sintered which is not less than 80% of a Cr content in the inside of the sintered product.

The reasons why the contents of Cr, Ni, Mo, C, O and N are defined as set forth above are described. All these elements are important for influencing the corrosion resistance.

In the practice of the invention, the concentration of Cr is defined in the range of from 18 to 28 wt %, This is because at a higher content of Cr, the corrosion resistance is more improved. If the content is less than 18 wt %, a desired corrosion resistance cannot be obtained. On the other hand, over 28 wt %, not only an economical problem arises, but also a problem on the brittleness based on the sigma phase is unfavorably produced.

Ni is an element which is used to produce the austenite phase. The range capable of forming a dual-phase stainless steel composition is from 4 to 12 wt % in the present invention.

If the content is less than 4 wt %, only a ferrite single phase is formed without formation of a dual-phase stainless steel. On the other hand, over 12 wt %, a more appreciable effect is not recognized with poor economy.

It is well known that a lower content of C leads to a more improvement in the corrosion resistance. If the content exceeds 0.06 wt %, a liquid phase appears, so that pores become larger in size, and carbides of Fe and Cr are produced with the appearance of a region of a low Cr content, resulting in poor corrosion resistance.

At a lower content of O, densification proceeds more easily with a higher sintered density, so that the corrosion resistance is improved. However, when the content of O exceeds 0.3 wt %, Cr oxides are produced, impeding the sintering. Thus, a high density cannot be obtained with a poor corrosion resistance. Accordingly, the upper limit of the O content is preferably 0.3 wt %.

It will be noted that when the lowering of the density caused by the presence of the Cr oxides is not considerable, the deterioration of the corrosion resistance based directly on the increase in content of O is not extreme. Accordingly, a necessary corrosion resistance depending on the purpose may be ensured. The reduction in amount of C and O in the sintered product proceeds in the following manner:

$$C+O \rightarrow CO \text{ or } C+2O \rightarrow CO_2$$

The reaction rate is proportional to the product of the contents by wt % of C and O. The reaction time necessary for reducing, to below 0.06 wt %, the content of C which causes the corrosion resistance to deteriorate considerably can be shortened by increasing a tolerance value of the O content in final sintered product. If a required level of the corrosion resistance is not so high, the content of O should preferably exceed 0.3% from the economical viewpoint. However, over 0.7 wt %, the corrosion resistance deteriorates considerably and thus, the upper limit is 0.7 wt %.

Mo is an element which is the most effective in improving the resistances to corrosion and oxidation and is advantageous in improving mechanical characteristics by formation of solid solution in steel matrix.

In the practice of the invention, it is preferred that Mo is incorporated in an amount of from 0.5 to 4.0 wt %. If the content is less than 0.5 wt %, a desired corrosion resistance is not obtained. Over 4 wt %, problems of sigma brittleness and 475° C. brittleness unfavorably arise.

N as well as Ni is an element which is an austenite former. N may be contained within an appropriate range necessary for the stabilization of the dual-phase stainless steel of the invention. If the content is less than 0.05 wt %, the formation of the austenite is unsatisfactory. On the other hand, over 0.3 wt %, nitrides are unfavorably formed, thus impeding the corrosion resistance.

The sintered density ratio should be over 92%, inclusive, the maximum diameter of pore should be not larger than 20 μm, and the Cr content at the surface of sintered product as being sintered should be not less than 80% of the Cr content in the inside of sintered product. The reasons for these definitions are as set forth before.

The method for manufacturing the corrosion-resistant sintered alloy steel according to the invention is described.

This method comprises providing a steel powder which comprises from 18 to 28 wt % of Cr and from 4 to 12 wt % of Ni and which has an average particle size of not larger than 15 μm or a steel powder which from 18 to 28 wt % of Cr, from 4 to 12 wt % of Ni and from 0.5 to 4.0 wt % of Mo and which has an average particle size of not larger than 15 μm, adding a binder to the steel powder and molding the mixture, heating the resultant green body in a non-oxidative atmosphere to remove the binder from the body, sintering the thus debound body at a temperature of from 1000° to 1350° C. under a reduced pressure of not higher than 30 Torr, and further sintering in a non-oxidative atmosphere at a temperature of 1200° to 1350° C.

According to the latter method wherein the steel powder used as the starting material contains from 0.5 to 4.0 wt % of Mo, there can be obtained a sintered alloy steel having better characteristics.

In the method of the invention, the contents of Cr and Ni in the starting steel powder are defined within certain ranges, respectively. This is necessary for obtaining the above sintered alloy steel.

The average size of the steel powder is not larger than 15 μm for the reason stated in [1].

After the addition of the binder to the starting material, the molding is effected and then the binder is removed from the resulting molding, after which it is sintered. The addition of binder, the molding and the debinding have been described in detail in [1].

The sintering of the invention is constituted of two stages as has been detailed in [1]. The primary feature of the first stage resides in that the reduction and decarburization simultaneous reaction between oxides and occluded carbon which are contained in the debound body is promoted and the evaporation of Cr is suppressed. The primary feature of the second stage resides in that the lowering in concentration of Cr which will inevitably occur in the surface portion during the first stage is restored and the densification by sintering is promoted.

The first-stage sintering is carried out under conditions of a temperature of 1000° to 1350° C. and a pressure of not higher than 30 Torr.

At temperatures lower than 1000° C., the rate of the reduction and decarburization simultaneous reaction is low with costing much time to obtain sintered products having low contents of C and O, on the other hand, over 1350° C., evaporation of Cr becomes high. Therefore, the first-stage sintering is effected by heating at a temperature of from 1000° to 1350° C.

The sintering over 0.1 Torr, in the case of heating in the vacuum heating furnace by means of a vacuum pump alone without introduction of any gas from outside, and the sintering over 30 Torr, in the case of heating in which both the introduction of a non-oxidative gas from outside and the evacuation with a vacuum pump are used, are unlikely to promote the reduction/-decarburization simultaneous reaction of Cr oxides effectively. Preferred reduced pressure is up to 0.1 Torr in the former case, and up to 30 Torr in the latter case.

The second-stage sintering is carried out at a temperature of from 1200° to 1350° C. in a non-oxidative atmosphere. By this, high density of the sintered product and uniformity in the distribution of Cr concentration are achieved.

At temperatures lower than 1200° C., the density ratio of the sintered product is not improved remarkably and the Cr at the surface of the steel powder which is reduced by evaporation during the preceding sintering under reduced pressure cannot be supplemented by diffusion from the inside. On the other hand, over 1350° C., partial fusion takes place with the shape being not retained and thus, a product of a desired shape cannot be obtained. Accordingly, the sintering temperature is preferably in the range of 1200°-1350° C.

After the sintering under reduced pressure, sintering in a non-oxidative atmosphere is performed to impart a satisfactory corrosion resistance. Better corrosion resistance is obtained, if necessary, by carrying out the following procedure after the sintering in a non-oxidative atmosphere.

(1) Cooling from 900° to 300° C. in 2 hours or shorter.
(2) After keeping at 900° to 1200° C. for 1 minute or longer, cooling from 900° to 300° C. in 2 hours or shorter.
(3) After cooling, reheating to 900° to 1200° C. and cooling from 900° to 300° C. in 2 hours or shorter.

By sintering as described above, there is obtained the sintered product of the invention having a good corrosion resistance and good mechanical characteristics.

[4] The corrosion-resistant sintered alloy steel of the invention has a composition which comprises:

| | |
|---|---|
| Cr: | 13 to 25 wt % |
| C: | below 0.04 wt %, inclusive, and |
| O: | below 0.7 wt %, inclusive, |

with the balance of Fe and inevitable impurities, and which has a single phase structure of ferrite, a density ratio of not less than 92%, a maximum diameter of pore present in the structure of not larger than 20 μm, and a Cr content at the surface of the sintered product as being sintered which is not less than 80% of a Cr content in the inside of the sintered product.

Other corrosion-resistant sintered alloy steels of the invention comprise:

| | |
|---|---|
| Cr: | 13 to 25 wt %, |
| Mo: | below 10 wt %, inclusive, |
| C: | below 0.04 wt %, inclusive, and |
| O: | below 0.7 wt %, inclusive, |

with the balance of Fe and inevitable impurities, and have a single phase structure of ferrite, a density ratio of not less than 92%, a maximum diameter of pore present in the structure of not larger than 20 μm, and a Cr content at the surface of the sintered product as being sintered which is not less than 80% of a Cr content in the inside of the sintered product.

The reasons why the contents of Cr, Mo, C and O are defined as set forth above are due to the fact that these elements are all important for influencing the corrosion resistance.

Cr: at a higher content of Cr, the corrosion resistance is more improved. If the content is less than 13 wt %, the Fe-Cr phase diagram shows that such a steel is within a γ loop at a sintering temperature of 1000° to 1350° C., so that the α-phase sintering is impeded and high densification cannot be achieved. In addition, the corrosion resistance is impeded. Accordingly, the lower limit is 13 wt %.

On the other hand, over 25 wt %, a more appreciable effect is not recognized with poor economy. Moreover, if the Cr content increases, problems on sigma brittleness and 475° C. brittleness arise. Accordingly, the upper limit is 25 wt %.

C: a lower content of C leads to a more improvement in the corrosion resistance. If the content exceeds 0.04 wt %, a liquid phase appears, so that pores become larger in size, and carbides of Fe and Cr are produced with the appearance of a region of a low Cr content, resulting in poor corrosion resistance.

O: at a lower content of O, densification proceeds more easily with a higher sintered density, so that the corrosion resistance is improved. However, when the content of O exceeds 0.3 wt %, Cr oxides are produced, impeding the sintering. Thus, a high density cannot be obtained with a poor corrosion resistance.

It will be noted that when the lowering of the density caused by the presence of the Cr oxides is not considerable, the deterioration of the corrosion resistance based directly on the increase in content of O is not extreme. Accordingly, a necessary corrosion resistance depending on the purpose may be ensured. The reduction in amount of C and O in the sintered product proceeds in the following manner:

$$C+O \rightarrow CO \text{ or } C+2O \rightarrow CO_2$$

The reaction rate is proportional to the product of the contents by wt % of C and O. The reaction time necessary for reducing, to below 0.04 wt %, the content of C which causes the corrosion resistance to deteriorate considerably can be shortened by increasing a tolerance value of the O content in final sintered product. If a required level of the corrosion resistance is not so high, the content of O should preferably exceed 0.3% from the economical viewpoint. However, over 0.7 wt %, the corrosion resistance deteriorates considerably and thus, the upper limit is 0.7 wt %.

Mo: Mo is an element which is the most effective in improving the resistances to corrosion and oxidation and is advantageous in improving mechanical characteristics by formation of solid solution in steel matrix. However, over 10 wt %, problems on sigma brittleness and 475° C. brittleness arise. Accordingly, the upper limit is 10 wt %.

As described above, Mo is a metal effective in improving the resistances to corrosion and oxidation and the sintered alloy steel containing Mo has better resistances to corrosion and oxidation.

The sintered density ratio should be over 92%, inclusive, the maximum diameter of pore should be not larger than 20 μm, and the Cr content at the surface of sintered product should be not less than 80% of the Cr content in the inside of sintered product. The reasons for these definitions are as set forth before.

An example of the method for manufacturing the above corrosion-resistance sintered alloy steels is described.

The method comprises providing an alloy steel powder which comprises from 13 to 25 wt % of Cr and which has an average particle size of not larger than 15 μm or an alloy steel powder which comprises from 13 to 25 wt % of Cr, not larger than 10 wt % of Mo and which has an average particle size of not larger than 15 μm, adding a binder to the steel powder and molding the mixture, heating the resultant green body in a non-oxidative atmosphere to remove the binder from the body, sintering the thus debound body at a temperature of from 1000° to 1350° C. under a reduced pressure of not higher than 30 Torr, and further sintering in a non-oxidative atmosphere at a temperature of 1200° to 1350° C. at normal pressures.

According to the latter method wherein the steel powder used as the starting material contains not larger than 10 wt % of Mo, there can be obtained a sintered alloy steel having better characteristics.

The average size of the steel powder is not larger than 15 μm for the reason stated in [1].

After the addition of the binder to the starting material, the molding is effected and then the binder is removed from the resulting molding, after which it is sintered. The addition of binder, the molding and the debinding have been described in detail in [1].

The sintering of the invention which has been described in detail in [1], is constituted of two stages. The primary feature of the first stage resides in that the reduction and decarburization simultaneous reaction between oxides and occluded carbon which are contained in the debound body is promoted and the evaporation of Cr is suppressed. The primary feature of the second stage resides in that the lowering in concentration of Cr which will inevitably occur in the surface portion during the first stage is restored and the densification by sintering is promoted.

The first-stage sintering is carried out under conditions of a temperature of 1000° to 1350° C. and a pressure of not higher than 30 Torr.

At temperatures lower than 1000° C., the rate of the reduction and decarburization simultaneous reaction is slow with costing much time to obtain sintered products having low contents of C and O. On the other hand, over 1350° C., the densification by sintering quickly proceeds with an impediment of the diffusion of CO gas, so that the reduction and decarburization simultaneous reaction does not proceed efficiently and the evaporation of Cr becomes very fast. Accordingly, the temperature range is preferably 1000°–1350° C. The sintering over 0.1 Torr, in the case of heating in the vacuum heating furnace by means of a vacuum pump alone without introduction of any gas from outside, and the sintering over 30 Torr, in the case of heating in which both the introduction of a non-oxidative gas from outside and the evacuation with a vacuum pump are used, are unlikely to promote the reduction/decarburization simultaneous reaction of Cr oxides effectively. Preferred reduced pressure is up to 0.1 Torr in the former case, and up to 30 Torr in the latter case.

The second-stage sintering is carried out at a temperature of from 1200° to 1350° C. in a non-oxidative atmosphere. By this, high density of the sintered product and uniformity in the distribution of Cr concentration are achieved.

At temperatures lower than 1200° C., the density ratio of the sintered product is not improved remarkably and the Cr at the surface of the steel powder which is reduced by evaporation during the proceeding sintering under reduced pressure cannot be supplemented by diffusion from the inside. On the other hand, over 1350° C., partial fusion takes place with the shape being not retained and thus, a product of a desired shape cannot be obtained. Accordingly, the sintering temperature is preferably in the range of 1200°-1350° C.

After the sintering under reduced pressure, sintering in a non-oxidative atmosphere is performed to impart a satisfactory corrosion resistance. Better corrosion resistance is obtained, if necessary, by carrying out the following procedure after the sintering in a non-oxidative atmosphere.

(1) Cooling from 900° to 300° C. in 2 hours or shorter.
(2) After keeping at 900° to 1200° C. for 1 minute or longer, cooling from 900° to 300° C. in 2 hours or shorter.
(3) After cooling, reheating to 900° to 1200° C. and cooling from 900° to 300° C. in 2 hours or shorter.

EXAMPLES

The present invention is described by way of examples, which should not be construed as limitation thereof.

EXAMPLES 1 TO 6 AND COMPARATIVE EXAMPLES 1 TO 7

A starting powder was a water atomized steel powder having the following composition:

Cr: 12 to 28 wt %
Ni: 5 to 26 wt %
Mo: 5 to 12 wt %
C: ≦0.05 wt %
O: 0.2 to 1.0 wt %

The powder was classified to have an average particle size of 8 μm, to which a thermoplastic resin and wax were added and kneaded by means of a pressure kneader. The mixing ratio by weight was 9:1. The mixture was subjected to an injection molding machine in the form of a rectangular parallelepiped with the following dimension:

length: 40 mm
width: 20 mm
thickness: 3 mm.

Each molding sample was heated at a heating rate of 10° C./hour to 600° C. in an atmosphere of nitrogen to remove the binder therefrom so as to the C/O molar ratio be 1.0 to 2.0. The sample was subsequently sintered in vacuum ($<10^{-3}$ Torr) for 1 hour or over, followed by keeping in an atmosphere of Ar at normal pressures at 1300° C. for 3 hours.

After cooling, the density ratio was determined from a density measured according to the Archimedean method and a true density, and the contents of C and O in the sintered product were analyzed. For evaluation of the corrosion resistance, the sample was allowed to stand for 24 hours in artificial sweet, after which whether or not corrosion was produced was microsteroscopically confirmed. The case where no rust was found was evaluated as good and the case where rust was produced even in a slight degree or discoloration took place was evaluated as rust generation.

The maximum pore size (Dmax) was determined by embedding a sintered product in resin, polishing the embedded product, and subjecting to observation through an optical microscope and also to image processing, after which it was calculated according to the following equation.

$$Dmax = 2 \times \sqrt{Smax/\pi}$$

wherein Smax: a sectional area of a pore having a maximum sectional area among pores.

The concentration distribution of alloy components in the sintered alloy steel was determined using the same sample as used for the maximum pore size by the EMPA line analysis of the section of the sintered product covering from the surface of the product to its center. Cr and other elements were subjected to the determination of the concentration distribution.

The results are shown in Table 1.

As will be apparent from Table 1, the sintered alloy steels of Examples 1 to 6 had the following compositions:

| | |
|---|---|
| Cr: | 16 to 25 wt % |
| Ni: | 8 to 24 wt % |
| C: | ≦0.06 wt % |
| O: | ≦0.3 wt % |

with or without Mo in an amount of Mo≦10 wt %.

The alloy steels had a density ratio of not less than 92%, a maximum pore size of not larger than 20 μm and an uniform concentration distribution of the alloy elements. Accordingly, no rust was found when determined by the corrosion test using artificial sweat or no discoloration was observed, thus sound sintered products being obtained.

On the other hand, the sintered alloy steels of Comparative Examples 1 to 7 had alloy elements in amounts outside the ranges of the invention or had a content of C over 0.06 wt % with formation of large-sized pores although the density increased by liquid phase sintering. Accordingly, a number of rusts were observed as determined by the artificial sweat test. With the case where the content of O exceeded 3 wt %, the density ratio was less than 92% by hindrance of sintering with oxides and the maximum pore size exceeds 20 μm. This is the reason why the corrosion resistance is poor.

In Comparative Examples 2 and 5, the content of Cr or Mo is larger and the σ phase is permitted to settle, resulting in deterioration of the corrosion resistance.

TABLE 1

| No. | Composition (wt %) Cr | Ni | Mo | C | O | Density ratio (%) | Maximum pore size (μm) | Concentration distribution* | Corrosion resistance |
|---|---|---|---|---|---|---|---|---|---|
| Example 1 | 18 | 12 | 2.5 | 0.01 | 0.04 | 95.3 | 18 | Uniform | Good |
| Example 2 | 24 | 12 | 2.5 | 0.03 | 0.2 | 93.1 | 19 | Uniform | Good |
| Example 3 | 18 | 20 | 2.5 | 0.04 | 0.2 | 92.8 | 19 | Uniform | Good |
| Example 4 | 18 | 12 | 0.5 | 0.01 | 0.05 | 94.2 | 18 | Uniform | Good |

TABLE 1-continued

| No. | Composition (wt %) Cr | Ni | Mo | C | O | Density ratio (%) | Maximum pore size (μm) | Concentration distribution* | Corrosion resistance |
|---|---|---|---|---|---|---|---|---|---|
| Example 5 | 18 | 12 | 8 | 0.05 | 0.1 | 93.8 | 19 | Uniform | Good |
| Example 6 | 18 | 8 | — | 0.03 | 0.1 | 95.8 | 17 | Uniform | Good |
| Comparative Example 1 | 12 | 12 | — | 0.05 | 0.2 | 93.1 | 18 | Uniform | Rust generation |
| Comparative Example 2 | 28 | 12 | — | 0.06 | 0.2 | 94.8 | 20 | Uniform | Rust generation |
| Comparative Example 3 | 16 | 5 | — | 0.05 | 0.3 | 94.3 | 18 | Uniform | Rust generation |
| Comparative Example 4 | 16 | 26 | — | 0.05 | 0.2 | 92.0 | 22 | Uniform | Rust generation |
| Comparative Example 5 | 18 | 12 | 12 | 0.06 | 0.2 | 92.0 | 20 | Uniform | Rust generation |
| Comparative Example 6 | 16 | 12 | 2.5 | 0.08 | 0.1 | 93.8 | 20 | Uniform | Rust generation |
| Comparative Example 7 | 16 | 12 | 2.5 | 0.05 | 0.4 | 91.5 | 26 | Uniform | Rust generation |

Note) *Sintered product whose Cr concentration at the suface thereof is not less than 80% of the Cr concentration in the inside was evaluated as "uniform", and less than 80% sintered product was evaluated as "non-uniform."

EXAMPLES 7 AND 8 AND COMPARATIVE EXAMPLE 8

A starting powder as used in Example 1 was subjected to classification to obtain steel powders having average sizes of 8 μm, 12 μm and 18 μm. In the same manner as in Example 1, after the molding and sintering, the density ratio and the corrosion resistance by the artificial sweat test were determined. The results are shown in Table 2.

For the average particle sizes of 8 μm and 12 μm, test pieces obtained had a sintered density ratio of not less than 92% and a maximum pore size of not larger than 20 μm. These test pieces were used for the corrosion resistance test, with the result that no change was found prior to and after the test. On the other hand, the use of the starting powder having an average particle size of 18 μm results in a density ratio as low as 91% and a maximum pore diameter over 20 μm, with the tendency toward corrosion. Pitting corrosion was produced with a number of rusts being observed.

TABLE 2

| No | Average particle size (μm) | Density ratio (%) | Maximum pore diameter (μm) | Concentration distribution* | Corrosion resistance |
|---|---|---|---|---|---|
| Example 7 | 8 | 95.7 | 18 | Uniform | Good |
| Example 8 | 12 | 93.8 | 20 | Uniform | Good |
| Comparative Example 8 | 18 | 91.0 | 25 | Uniform | Rust Generation |

Note) *Sintered product whose Cr concentration at the surface thereof is not less than 80% of the Cr concentration in the inside was evaluated as "uniform", and less than 80% sintered product was evaluated as "non-uniform".

EXAMPLES 9 AND 10 AND COMPARATIVE EXAMPLES 9 AND 10

A starting powder having an average size of 8 μm as used in Example 1 was subjected kneading, molding and removal of the binder in the same manner as in Example 1.

The resulting molding sample was heated from room temperature to 1300° C. in vacuum ($10^{-3}$ Torr), at which it was kept for 1 hour and further kept in an atmosphere of Ar for 1 hours (Example 9).

In Example 10, the above procedure was repeated except that the keeping temperature in vacuum was 1100° C.

In Comparative Examples 9 and 10, the sintering in vacuum alone was effected.

These results are shown in Table 3.

In examples 9 and 10, after the sintering in vacuum, the moldings were sintered in an atmosphere of Ar, so that there were obtained corrosion-resistant sintered products wherein the content of Cr at the surface of the product was not less than 95% of the Cr content in the center of the product. This is because when the sintering in vacuum is effected, the following contents of C and O are attained $$C \leqq 0.06 \text{ wt } \%$$

$$O \leqq 0.3 \text{ wt } \%$$

and further high temperature sintering over 1300° C. facilitates densification to attain a density ratio of not less than 92% and to suppress a maximum pore diameter to 18 μm, thereby achieving an uniform distribution of the alloy elements.

In Comparative Example 9, the sintering-in-vacuum temperature is 1300° C with low contents of C and O. The content of Cr at the surface only by the sintering in vacuum is 10% of the Cr content in the center of the sintered product, resulting in poor corrosion resistance. Comparative Example 10 also makes use of the sintering in vacuum with a low content of Cr at the surface. The content of C is so high that high densification is attained by the liquid phase sintering but the corrosion resistance is poor because of the high content of C.

EXAMPLE 11 TO 13 AND COMPARATIVE EXAMPLES 11 AND 12

A starting powder used was a steel powder of the following composition

| | |
|---|---|
| Cr: | 18 wt % |

-continued

| | |
|---|---|
| Ni: | 12 wt % |
| Mo: | 2.5 wt % |
| C: | ≦0.05 wt % |
| O: | 0.5 to 1.0 wt % |

and kneaded in the same manner as in Example 1, followed by molding and removal of the binder. Subsequently, the moldings were each heated to 400° to 700° C. in an atmosphere of wet hydrogen wherein the C/O molar ratio in the moldings was controlled by changing the temperature. The moldings were heated from room temperature to 1200° C. in vacuum ($<10^{-3}$ Torr) at which they were kept for 1 hour and then an Ar gas was introduced, followed by keeping for 3 hours. The results are shown in Table 4.

As will be apparent from Table 4, the contents of C and O in the sintered product depend on the C/O molar ratio, thus influencing the corrosion resistance.

In Examples 11 to 13, the molar ratio is in the range of from 0.3 to 3.0, so that the sintered product had low contents of C and 0. However, a smaller molar ratio as in Comparative Example 11 indicates that the content of O in the molding is in excess. This means that O remains in the sintered product, thus impeding the sintering and rendering the pores large. Thus, the high density cannot be obtained with a poor corrosion resistance.

On the contrary, a larger C/O molar ratio as in Comparative Example 12 means an excess of C in the molding. In the sintered product, C is left with the appearance of a liquid phase. Although the density increases, the pores are made large in size and the content of C becomes high, thus leading to a poor corrosion resistance.

ple having a length of 40 mm, a width of 20 mm and a thickness of 8 mm.

Thereafter, the molding was heated for debinding in an atmosphere of nitrogen to 500° C. at a heating rate of 5° C./hour. The thus heated molding was further heated at 500° to 700° C. in an atmosphere of wet hydrogen to control the amounts of C and O. Subsequently, the sample was heated to and kept at 1170° C. in vacuum (<0.001 Torr), into which Ar gas was introduced and the temperature was raised to 1350° C., at which it was retained for 1 hour. The retention time at 1170° C., the amounts of C and O in the sintered product, the density ratio, the maximum pore diameter, the concentration distribution and the results of the artificial sweat test are shown in Table 5.

From Table 5, it will be seen that the sintered products in which the amount of O exceeds 0.3 wt % suffer corrosion when determined by the artificial sweat test of 24 hours but with the sintered products having an amount of O not larger than 0.7 wt %, no rust generation is found by the artificial sweat test of 12 hours. At a higher content of O, the time required for reducing the amount of C to not larger than 0.06 wt % is shorter (in Examples 14 to 17 and Comparative Example 13, the times required to reduce the amount of C to a level of approximately 0.02% were compared). Accordingly, the sintered products which had a content of O from 0.3 wt % to 0.7 wt % did not extremely deteriorate in the corrosion resistance with good economy. In particular, in the manufacture of the thick part as in these examples, it takes a long time before both C and O are reduced in amount. The sintered products wherein the amount of C which is more harmful for the corrosion resistance is reduced to below 0.06 wt % and which contains from 0.3 to 0.7 wt % of O are economically advantageous.

TABLE 3

| No. | Sintering conditions Atmosphere (Temperature °C. × Retention Time) | Density ratio (%) | C (Wt %) | O (Wt %) | Maximum pore diameter (μm) | Concentration distribution* | Corrosion resistance |
|---|---|---|---|---|---|---|---|
| Example 9 | Vacuum (1300 × 1 h) + Ar (1300 × 2 h) | 95.1 | 0.06 | 0.1 | 18 | 95% | Good |
| Example 10 | Vacuum (1100 × 1 h) + Ar (1300 × 2 h) | 96.2 | 0.03 | 0.08 | 18 | 95% | Good |
| Comparative Example 9 | Vacuum (1300 × 3 h) | 95.8 | 0.05 | 0.10 | 20 | 10% | Rust generation |
| Comparative Example 10 | Vacuum (1380 × 1 h) | 97.8 | 0.20 | 0.09 | 32 | 10% | Rust generation |

Note) *Ratio of Cr Concentration at the surface of sintered product to Cr Concentration in the inside of the product

TABLE 4

| No. | c/o Molar ratio in molding after removal of binder | Density ratio (%) | C (Wt %) | O (Wt %) | Maximum pore diameter (μm) | Concentration distribution* | Corrosion resistance |
|---|---|---|---|---|---|---|---|
| Example 11 | 0.8 | 94.3 | 0.05 | 0.1 | 18 | Uniform | Good |
| Example 12 | 1.6 | 95.1 | 0.04 | 0.2 | 18 | Uniform | Good |
| Example 13 | 2.6 | 95.4 | 0.04 | 0.2 | 16 | Uniform | Good |
| Comparative Example 11 | 0.2 | 90.3 | 0.02 | 0.5 | 28 | Uniform | Rust generation |
| Comparative Example 12 | 3.3 | 97.8 | 0.26 | 0.04 | 32 | Uniform | Rust generation |

Note) *Sintered product whose Cr concentration at the surface thereof is not less than 80% of the Cr concentration in the inside was evaluated as "uniform", and less than 80% sintered product was evaluated as "non-uniform."

EXAMPLES 14 TO 17 AND COMPARATIVE EXAMPLE 13

A starting molding material as in Example 1 was used for injection molding a rectangular parallelepiped sam-

TABLE 5

| No | Retention time (min) | Density ratio (%) | C (wt %) | O (wt %) | Max. pore concentration | Concentration distribution | Corrosion resistance 24 h | 12 h |
|---|---|---|---|---|---|---|---|---|
| Example 14 | 120 | 96.1 | 0.02 | 0.22 | 17 | Uniform | Good | Good |
| Example 15 | 75 | 95.6 | 0.03 | 0.34 | 16 | Uniform | Rust Generation | Good |
| Example 16 | 60 | 93.8 | 0.02 | 0.52 | 17 | Uniform | Rust Generation | Good |
| Example 17 | 30 | 93.5 | 0.02 | 0.65 | 18 | Uniform | Rust Generation | Good |
| Comparative Example 13 | 30 | 92.3 | 0.02 | 0.75 | 17 | Uniform | Rust Generation | Rust Gen. |

EXAMPLES 18 TO 25 AND COMPARATIVE EXAMPLES 14 AND 15

Moldings as obtained in Example 1 were provided and subjected to debinding treatment in the same manner as in Example 1. In the sintering, the first-stage vacuum sintering was effected using different atmospheric gases while keeping at 1120° C. for 1 hours. Subsequently, the sintering was effected in an Ar gas under an atmospheric pressure at 1320° C. for 2 hours in all the cases, thereby obtaining sintered steels. It will be noted that during the vacuum sintering, the valve of a vacuum exhaust system was throttled or an Ar gas was introduced in a very small amount by the use of a needle valve to regulate or control the degree of vacuum. The sintered steels were subjected to similar tests as in Example 1. The sintering conditions of the sintered steels and the results of the density ratio, the amounts of C and O, the maximum pore diameter, the Cr concentration distribution and the corrosion resistance are summarized in Table 6. In Table 6, when the degree of vacuum is controlled by throttling the valve during the vacuum sintering, the pressure is indicated and when a small amount of Ar is introduced, the term "Ar" is specified after the pressure value.

As will be apparent from Table 6, when the degree of vacuum is lost due to the insufficiency of the evacuation for vacuum at the time of the vacuum sintering (Examples, 18, 24, 25 and Comparative Example 15), the contents of C and O in the resultant sintered steels are high, and at a vacuum of 1 Torr (Comparative Example 15), rust is produced in the sintered steel and at a pressure of not larger than 0.1 Torr (Examples 18, 24 and 25), low contents of C and O are ensured without generation of any rust.

On the other hand, where the evacuation for vacuum is satisfactory and a non-oxidative gas is introduced (Examples 19 to 23 and Comparative Example 14), the contents of C and O slightly increase but no rust is produced until the pressure in the furnace is increased to a level less than 30 Torr (Examples 19 to 23). Over 30 Torr (Comparative Example 14), the increase in amount of C and O becomes considerable with the generation of rust.

As described above according to the method of the invention where the evacuation is performed to a satisfactory extent that the pressure is not larger than 0.1 Torr, in the case of sintering in vacuum, or where the pressure is less than 30 Torr, in the case of introduction of a non-oxidative gas, sintered steels having a good corrosion resistance can be obtained.

TABLE 6

| No. | Sintering conditions | Density ratio (%) | C (Wt %) | O (Wt %) | Maximum pore diameter (μm) | Concentration distribution* | Corrosion resistance |
|---|---|---|---|---|---|---|---|
| Example 18 | $10^{-3}$ Torr (1120° C. × 1 h) + 760 Torr Ar (1320° C. × 2 h) | 94.1 | 0.02 | 0.20 | 16 | Uniform | Good |
| Example 19 | 0.5 Torr Ar (1120° C. × 1 h) + 760 Torr Ar (1320° C. × 2 h) | 94.0 | 0.02 | 0.21 | 17 | Uniform | Good |
| Example 20 | 1 Torr Ar (1120° C. × 1 h) + 760 Torr Ar (1320° C. × 2 h) | 94.2 | 0.02 | 0.20 | 16 | Uniform | Good |
| Example 21 | 5 Torr Ar (1120° C. × 1 h) + 760 Torr Ar (1320° C. × 2 h) | 93.9 | 0.02 | 0.20 | 17 | Uniform | Good |
| Example 22 | 10 Torr Ar (1120° C. × 1 h) + 760 Torr Ar (1320° C. × 2 h) | 94.1 | 0.03 | 0.24 | 16 | Uniform | Good |
| Example 23 | 20 Torr Ar (1120° C. × 1 h) + 760 Torr Ar (1320° C. × 2 h) | 93.8 | 0.05 | 0.27 | 18 | Uniform | Good |
| Comparative Example 14 | 40 Torr Ar (1120° C. × 1 h) + 760 Torr Ar (1320° C. × 2 h) | 93.6 | 0.08 | 0.32 | 18 | Uniform | Rust generation |
| Example 24 | $10^{-2}$ Torr (1120° C. × 1 h) + 760 Torr Ar (1320° C. × 2 h) | 94.0 | 0.04 | 0.25 | 18 | Uniform | Good |
| Example 25 | 0.1 Torr (1120° C. × 1 h) + 760 Torr Ar (1320° C. × 2 h) | 93.8 | 0.05 | 0.28 | 19 | Uniform | Good |
| Comparative Example 15 | 1 Torr (1120° C. × 1 h) + 760 Torr Ar (1320° C. × 2 h) | 92.8 | 0.09 | 0.36 | 20 | Uniform | Rust generation |

Note) *At the vacuum sintering effected in Examples 18, 24, 25 and Comparative Example 15, evacuation alone was made; a small amount of Ar gas was not introduced.

EXAMPLE 26 AND COMPARATIVE EXAMPLES 16 TO 18

A starting powder was a water atomized stainless steel powder having a composition comprising:

| | |
|---|---|
| Cr: | 14 to 29 wt % |
| Ni: | 4 to 21 wt % |
| C: | 0.02 to 0.06 wt % |
| N: | 0.01 to 0.02 wt % |
| Mo: | 0 or 2.2 wt % |

with the balance of Fe and inevitable impurities. This powder was subjected to classification to have an average particle size of 12 μm, after which 4 wt % of polyethylene and 8 wt % of paraffin wax were added, followed by kneading by the use of a pressure kneader. The mixture was subjected to injection molding at an injection temperature of 150° C. at an injection pressure of 1000 kg/cm$^2$ to obtain a molding having a size of 40 mm×20 mm×2 mm.

Thereafter, the molding was heated to 600° C. at a rate of 10° C./hour in an atmosphere of Ar thereby removing the binder.

Moreover, the molding was heated to 1150° C. and kept at a pressure of $10^{-3}$ Torr for 1 hour, followed by raising the temperature to 1300° C. and keeping in an atmosphere containing 15% of $N_2$ with the balance of Ar under a total pressure of 1 atm., for 2 hours to obtain a sintered product.

After cooling, the density ratio was determined from the density measured according to the Archimedean method and a true density, and the contents of C and N in the sintered product were analyzed by the combustion-infrared spectroscopy and the inert gas fusion-heat conductivity method, respectively.

With regard to Cr, Ni and Mo, their contents were substantially equal to those in the starting powder and no specific analysis was made.

Moreover, the evaluation of corrosion resistance and the measurement of the maximum pore diameter (Dmax) were made in the same manner as in Example 1.

The results are shown in Table 7.

EXAMPLE 27 AND COMPARATIVE EXAMPLE 19

The general procedure of Example 26 was repeated except that a starting powder was a water atomized stainless steel powder having a composition comprised of 18.1% of Cr, 8.5% of Ni, 0.05% of C, 0.02% of N and the balance of Fe and inevitable impurities with average particle sizes of 8 μm, 12 μm and 18 μm, thereby obtaining sintered products. These products were subjected to various tests in the same manner as in Example 26.

The results are shown in Table 8.

EXAMPLE 28 AND COMPARATIVE EXAMPLE 20

The general procedure of Example 26 was repeated except that a starting powder was a water atomized stainless steel powder having a composition comprised of 18.1% of Cr, 8.5% of Ni, 0.05% of C, 0.02% of N and the balance of Fe and inevitable impurities and that the temperature and pressure of the first-stage sintering after removal of the binder were those indicated in Table 9, thereby obtaining sintered products. These products were subjected to various tests as in Example 26. The results are shown in Table 9.

EXAMPLE 29 AND COMPARATIVE EXAMPLES 21 AND 22

The general procedure of Example 26 was repeated except that a starting powder was a water atomized stainless steel powder having a composition comprised of 18.1% of Cr, 8.5% of Ni, 0.05% of C, 0.02% of N and the balance of Fe and inevitable impurities and that the temperature and the partial pressure of nitrogen gas in the second-stage sintering were those indicated in Table 10, thereby obtaining sintered products. These products were subjected to various tests as in Example 26. The results are shown in Table 10.

TABLE 7

| | | Chemical Composition (wt %) | | | | | Density ratio | Maximum pore size | Corrosion | Concentration |
|---|---|---|---|---|---|---|---|---|---|---|
| | | Cr | Ni | C | N | Mo | (%) | (μm) | resistance | distribution |
| Example 26 | Inventive Example 1 | 16.5 | 8.2 | 0.03 | 0.16 | — | 93.4 | 16 | Good | *Uniform |
| | Inventive Example 2 | 18.1 | 8.5 | 0.02 | 0.18 | — | 94.1 | 17 | Good | Uniform |
| | Inventive Example 3 | 24.2 | 14.8 | 0.01 | 0.29 | — | 93.5 | 16 | Good | Uniform |
| | Inventive Example 4 | 16.5 | 12.8 | 0.03 | 0.15 | 2.2 | 94.2 | 17 | Good | Uniform |
| Comparative Example 16 | | 14.1 | 8.1 | 0.02 | 0.12 | — | 94.3 | 15 | Rust generation | Uniform |
| Comparative Example 17 | | 28.2 | 20.1 | 0.03 | 0.42 | — | 93.6 | 16 | Rust generation | Uniform |
| Comparative Example 18 | | 18.1 | 4.3 | 0.02 | 0.19 | — | 94.2 | 18 | Rust generation | Uniform |

Note) *Sintered product whose Cr concentration at the suface is not less than 80% of the Cr concentration in the inside was evaluated as "uniform".

TABLE 8

| | | Average size of steel powder | Chemical composition (Wt %) | | | | Density ratio | Maximum pore size | Corrosion | Concentration |
|---|---|---|---|---|---|---|---|---|---|---|
| | | (mm) | Cr | Ni | C | N | (%) | (μm) | resistance | distribution |
| Example 26 | Inventive Example 5 | 8 | 18.1 | 8.5 | 0.02 | 0.18 | 95.2 | 15 | Good | *Uniform |
| | Inventive Example 2 | 12 | 18.1 | 8.5 | 0.02 | 0.18 | 94.1 | 17 | Good | Uniform |
| Comparative Example 19 | | 18 | 18.1 | 8.5 | 0.02 | 0.18 | 89.0 | 22 | Rust generation | Uniform |

Note) *Sintered product whose Cr concentration at the suface is not less than 80% of the Cr concentration in the inside was evaluated as "uniform".

TABLE 9

| | | First-stage sintering conditions | | | | | | Density ratio | Maximum pore size | Corrosion resistance | Concentration distribution |
|---|---|---|---|---|---|---|---|---|---|---|---|
| | | Temperature (°C.) | Pressure (Torr) | Chemical composition (Wt %) Cr | Ni | C | N | (%) | (μm) | | |
| Example 28 | Inventive Example 2 | 1150 | $10^{-3}$ | 18.1 | 8.5 | 0.02 | 0.18 | 94.1 | 17 | Good | *Uniform |
| | Inventive Example 6 | 1200 | $10^{-3}$ | 18.1 | 8.5 | 0.04 | 0.19 | 95.2 | 16 | Good | Uniform |
| | Inventive Example 7 | 1200 | $10^{-1}$ | 18.1 | 8.5 | 0.05 | 0.20 | 95.3 | 16 | Good | Uniform |
| Comparative Example 20 | | 1150 | 760 | 18.1 | 8.5 | 0.31 | 0.18 | 95.2 | 18 | Rust generation | Uniform |

Note) *Sintered product whose Cr concentration at the surface is not less than 80% of the Cr concentration in the inside was evaluated as "uniform."

TABLE 10

| | | Second-stage sintering conditions | | Chemical composition (Wt %) | | | | Density ratio | Maximum pore size | Corrosion resistance | Concentration distribution |
|---|---|---|---|---|---|---|---|---|---|---|---|
| | | Temperature (°C.) | Ni: Partial pressure (atm) | Cr | Ni | C (%) | N (μm) | (%) | (μm) | | |
| Example 29 | Inventive Example 2 | 1300 | 0.15 | 18.1 | 8.5 | 0.02 | 0.18 | 94.1 | 17 | Good | *Uniform |
| | Inventive Example 8 | 1300 | 0.50 | 18.1 | 8.5 | 0.03 | 0.31 | 94.3 | 17 | Good | Uniform |
| | Inventive Example 9 | 1300 | 0.80 | 18.1 | 8.5 | 0.02 | 0.39 | 94.2 | 17 | Good | Uniform |
| | Inventive Example 10 | 1250 | 0.15 | 18.1 | 8.5 | 0.03 | 0.17 | 93.8 | 18 | Good | Uniform |
| | Inventive Example 11 | 1350 | 0.15 | 18.1 | 8.5 | 0.02 | 0.18 | 95.2 | 16 | Good | Uniform |
| Comparative Example 21 | | 1300 | 0.95 | 18.1 | 8.5 | 0.02 | 0.43 | 94.2 | 17 | Rust generation | Uniform |
| Comparative Example 22 | | 1200 | 0.15 | 18.1 | 8.5 | 0.02 | 0.19 | 91.5 | 21 | Rust generation | Uniform |

Note) *Sintered product whose Cr concentration at the surface is not less than 80% of the Cr concentration in the inside was evaluated as "uniform".

Example 26 deals with the influence of the chemical compositions of the starting steel powder and the sintered product on the corrosion resistance.

The sintered products obtained in the inventive examples had the chemical compositions, density ratio and maximum pore diameter within the scope of the invention, exhibiting a good corrosion resistance. On the other hand, the sintered products obtained in the Comparative Examples were appropriate with respect to the density ratio and the maximum pore diameter, but those of Comparative Examples 16 and 18 were reduced in amount of Cr and Ni which were effective for corrosion resistance, resulting in generation of rust. Since Comparative Example 17 deals with the case where Cr and N are in excess, the $\sigma$ phase appeared and Cr nitrides were produced. Accordingly, the corrosion resistance deteriorated with the generation of rust.

Example 27 deals with the influence of the average size of the starting powder on the corrosion resistance and the like.

In the inventive examples, the starting powders having average particle sizes of 8 μm and 12 μm, respectively, were used and the resultant sintered products had a sintered density ratio of not less than 92% and a maximum pore diameter of not larger than 20 μm. Both sintered products had a good corrosion resistance. On the other hand, since the Comparative Example makes use of the steel powder having an average size of 18 μm, the density ratio was as low as 89% and the maximum pore diameter exceeded 20 μm. Accordingly, pitting corrosion appeared with a number of rust. Example 28 deals with the influence of the first-stage sintering conditions (temperature and pressure) on the chemical composition of sintered product and the corrosion resistance and the like.

In the inventive examples, the resultant sintered products had a density ratio and a maximum pore diameter within the scope of the invention and had a C content of not larger than 0.05 wt % and an N content of from 0.05 to 0.40 wt %, exhibiting a good corrosion resistance. On the other hand, the sintered products obtained in the Comparative Examples had appropriate density ratio and maximum pore size and an N content of from 0.05 to 0.40 wt %, but the content of C exceeded 0.05 wt %, from which it was assumed that Cr carbides were produced with formation of low Cr regions. Rust generation which was considered due to the partial lowering of the corrosion resistance was observed.

Example 29 deals with the influence of the second-stage sintering conditions (temperature and partial pressure of $N_2$) on the chemical composition and corrosion resistance of sintered product.

The sintered products obtained in the inventive examples had a density ratio and a maximum pore ratio within the scope of the invention and had a C content of not larger than 0.05 wt % and an N content of from 0.05 to 0.40 wt %, resulting in a good corrosion resistance. On the other hand, the sintered products of Comparative Example 21 had appropriate density ratio and a C content of not larger than 0.05 wt %. However, the partial pressure of $N_2$ was inappropriate, so that the content of N was outside the range of from 0.05 to 0.40 wt %. Accordingly, in Comparative Example 21, it is considered that Cr nitrides produced with formation of low Cr content regions and rust generation takes place due to the partial lowering of the corrosion resistance. In Comparative Example 22, since the sintering temperature is low, the resultant sintered product had a density ratio as low as 91.5% and a maximum pore size over 20 μm. Accordingly, pitting corrosion was produced with a number of rusts.

EXAMPLE 30

The general procedure of Example 26 was repeated except that a starting powder was a water atomized stainless steel powder having a composition comprised of 18.1% of Cr, 8.5% of Ni, 0.05% of C, 0.02% of N and the balance of Fe and inevitable impurities and that the temperature of the first-stage sintering after removal of the binder, the second-stage sintering temperature and the partial pressure of $N_2$ were those indicated in Table 11, thereby obtaining a sintered product. The product was subjected to various tests as in Example 26. The results are shown in Table 11.

the binder from the molding so that the C/O molar ratio in the molding was in the range of from 1.0 to 2.0. Subsequently, the molding was sintered in vacuum ($<10^{-3}$ Torr) for over 1 hour and then kept at 1300° C. for 3 hours in an atmosphere of Ar gas at a normal pressure. Further, it was maintained at 1080° C. for 30 minutes and subjected to water cooling to obtain a dual-phase stainless steel.

After cooling, the density ratio was determined from a density measured according to the Archimedean method and a true density. The amounts of C and O in the sintered product were analyzed.

The evaluation of corrosion resistance and the measurement of maximum pore diameter, Dmax, were made in the same manner as in Example 1.

The concentration distribution of the alloy components in the sintered alloy steel was determined by the use of the same samples as used above by the EPMA line analysis of the section of sintered product from its surface to center. The concentration distribution of Cr and other elements was checked.

The results are shown in Table 12.

TABLE 11

| | | First-stage sintering conditions | | Second-stage sintering conditions | | Chemical composition (Wt %) | | | | Density ratio | Maximum pore size | Corrosion resistance | Concentration distribution |
|---|---|---|---|---|---|---|---|---|---|---|---|---|---|
| | | Temperature (°C.) | Pressure (Torr) | Temperature (°C.) | Ni: Partial pressure (atm) | Cr | Ni | C | N | (%) | (μm) | | (%)* |
| Example 30 | Inventive Example 2 | 1150 | $10^{-3}$ | 1300 | 0.15 | 18.1 | 8.5 | 0.02 | 0.18 | 94.1 | 17 | Good | 98 |
| Comparative Example 23 | | 1250 | $10^{-3}$ | 1150 | 0.10 | 18.1** | 8.5 | 0.05 | 0.21 | 92.5 | 19 | Rust generation | 30 |

Note) *Ratio of Cr Concentration at the surface of sintered product to Cr Concentration in the inside of the product
**Cr Concentration in the inside of sintered product

EXAMPLES 31 TO 36 AND COMPARATIVE EXAMPLES 24 TO 29

Water atomized steel powders having components and compositions indicated in Table 12 were provided as the respective starting powders.

Each steel powder was mixed with a thermoplastic resin organic binder composed mainly of an acrylic resin and wax at a mixing ratio by weight of 9:1 and kneaded by the use of a pressure kneader.

The mixture was injection molded into a rectangular parallelepiped having a size of 40 mm in length, 20 mm in width and 3 mm in thickness.

Each sample was heated to 600° C. in an atmosphere of nitrogen at a heating rate of 10° C./hour to remove

TABLE 12

| No. | Cr | Ni | Mo | N | C | O | Density ratio (%) | Maximum pore size (μm) | Concentration distribution* | Corrosion resistance |
|---|---|---|---|---|---|---|---|---|---|---|
| Example 31 | 20 | 5 | 2 | — | 0.01 | 0.03 | 94.8 | 18 | Uniform | Good |
| Example 32 | 25 | 5 | 2 | — | 0.01 | 0.18 | 94.2 | 19 | Uniform | Good |
| Example 33 | 20 | 11 | 4 | — | 0.03 | 0.09 | 93.9 | 19 | Uniform | Good |
| Example 34 | 20 | 5 | — | — | 0.02 | 0.08 | 94.4 | 18 | Uniform | Good |
| Example 35 | 25 | 5 | — | — | 0.03 | 0.12 | 93.1 | 19 | Uniform | Good |
| Example 36 | 20 | 5 | — | 0.2 | 0.03 | 0.08 | 94.3 | 19 | Uniform | Good |
| Comparative Example 24 | 15 | 5 | — | — | 0.06 | 0.12 | 93.2 | 19 | Uniform | Rust generation |
| Comparative Example 25 | 31 | 5 | — | — | 0.07 | 0.21 | 90.1 | 24 | Uniform | Rust generation |
| Comparative Example 26 | 18 | 2 | — | — | 0.05 | 0.20 | 93.5 | 19 | Uniform | Rust generation |
| Comparative Example 27 | 25 | 5 | 6 | — | 0.07 | 0.15 | 90.9 | 25 | Uniform | Rust generation |
| Comparative Example 28 | 18 | 5 | — | 0.5 | 0.08 | 0.15 | 92.5 | 20 | Uniform | Rust generation |
| Comparative Example 29 | 20 | 5 | — | — | 0.09 | 0.42 | 89.2 | 26 | Uniform | Rust generation |

Note) *Sintered product whose Cr concentration at the suface thereof is not less than 80% of the Cr concentration in the inside was evaluated as "uniform."

As will be apparent from Table 12, the sintered products of the inventive examples had all a density ratio of not less than 92%, a maximum pore diameter of not larger than 20 μm and a Cr concentration at the surface of sintered product not less than 80% of the Cr concentration in the inside. As a consequence, no rust was found when determined by a corrosion test using artificial sweat and thus sound sintered products were obtained.

On the other hand, with the Comparative Examples where the contents are outside the ranges of the invention, the density ratio is less than 92% or rust generation is found, thus the products being unsuitable for use as a sintered alloy steel.

EXAMPLES 37, 38 AND COMPARATIVE EXAMPLES 30, 31

In the same manner as in Example 31, a starting powder as used in Example 31 was kneaded and molded, after which the binder was removed.

The molding was subsequently heated from room temperature to 1250° C. in vacuum ($10^{-3}$ Torr), at which it was maintained for 1 hour, followed by changing the atmosphere to an atmosphere of Ar gas and keeping for 2 hours at a temperature of 1300° C. (Example 37).

In Example 38, the keeping temperature in the vacuum was changed to 1100° C. Comparative Examples 30 and 31 deal with the case where the sintering in the vacuum alone was carried out.

The results are shown in Table 13.

TABLE 13

| No. | Sintering conditions Atmosphere (Temperature °C. × Retention Time) | Density ratio (%) | C (Wt %) | O (Wt %) | Maximum pore diameter (μm) | Concentration distribution* | Corrosion resistance |
|---|---|---|---|---|---|---|---|
| Example 37 | Vacuum (1250 × 1 h) + Ar (1300 × 2 h) | 95.1 | 0.06 | 0.1 | 18 | 95% | Good |
| Example 38 | Vacuum (1100 × 1 h) + Ar (1300 × 2 h) | 96.2 | 0.03 | 0.08 | 18 | 95% | Good |
| Comparative Example 30 | Vacuum (1300 × 3 h) | 95.8 | 0.05 | 0.10 | 20 | 10% | Rust generation |
| Comparative Example 31 | Vacuum (1380 × 1 h) | 97.8 | 0.20 | 0.09 | 32 | 10% | Rust generation |

Note) *Ratio of the Cr concentration at the surface of sintered product to the Cr concentration in the inside In Examples 37 and 38, after the vacuum sintering the moldings are sintered in an atmosphere of Ar, so that the Cr content at the surface of the sintered product is not less than 95% of the Cr content in the center of the product, thus the sintered product having a good corrosion resistance.

This is considered for the following reason: C≦0.06 wt. % and O≦0.3 wt. % are attained by the vacuum sintering and the sintering at high temperatures not lower than 1300° C. is subsequently effected. By this, the densification proceeds to attain a density ratio of not less than 92% and to suppress a maximum pore diameter to a level of 18 μm, thereby uniformizing the alloy elements.

In Comparative Example 30, the sintering temperature in vacuum is 1300° C., so that the amounts of C and O are small. However, since the vacuum sintering alone is effected, the Cr content at the surface is 10% of the Cr content in the center of the sintered product. As a result, the corrosion resistance deteriorates.

Comparative Example 31 deals with the vacuum sintering alone with a low Cr content at the surface. Although the content of C is so high that high densification proceeds by the liquid phase sintering, the corrosion resistance is poor because of the high content of C.

EXAMPLES 39 TO 42 AND COMPARATIVE EXAMPLES 32 TO 35

Water atomized stainless steel powders were provided as starting powders having compositions comprising:

| | |
|---|---|
| Cr: | 10 to 28 wt % |
| Mo: | 0 to 12 wt % |

-continued

| | |
|---|---|
| C: | 0.05 wt % or below |
| N: | 0.3 wt % or below |

with the balance of Fe and inevitable impurities. Each powder was subjected to classification to have an average particle size of 12 μm, after which a thermoplastic resin and wax were added, followed by kneading by the use of a pressure kneader. The mixture was subjected to injection molding at an injection temperature of 120° to 160° C. at an injection pressure of 800 to 1200 kg/cm$^2$ to obtain a molding having a size of 40 mm×20 mm×2 mm.

Thereafter, the molding was heated to 600° C. at a rate of 10° C./hour in an atmosphere of $N_2$ and kept for 2 to 6 hours thereby removing the binder so that the C/O molar ratio in the molding was in the range of from 0.5 to 2.0. Moreover, the molding was heated to 1150° C. and kept at a pressure of $10^{-3}$ Torr for 1 hour, followed by raising the temperature to 1300° C. and keeping in an atmosphere of Ar for 2 hours to obtain a sintered product.

After cooling, the density ratio was determined from the density measured according to the Archimedean method and a true density, and the contents of C and O in the sintered product were analyzed.

The evaluation of the corrosion resistance and the measurement of the maximum pore diameter (Dmax) were made in the same manner as in Example 1.

The concentration distribution of the alloy components in the sintered alloy steel was determined using the same sample as used above by the EPMA line analysis of from the surface to the center of the section of the sintered product. The concentration distribution of Cr and other elements were checked.

The results are shown in Table 14.

As will be apparent from Table 14, the compositions of Examples 39 to 42 comprise from 13 to 25 wt % of Cr, 0.04 wt % or below of C and 0.03 wt % or below of O with or without 10 wt % or below of Mo and the sintered products have a density ratio of not less than 92%, a maximum pore diameter of not larger than 20 μm and an uniform concentration distribution of the alloy elements (Cr concentration at the surface of sintered product ≧0.8 of the Cr concentration in the inside of sintered product). Accordingly, no rust was found when determined by the corrosion test using artificial sweat and thus sound sintered products were obtained.

On the other hand, in Comparative Example 32, since the Cr content is 10 wt % and the effect of the α phase sintering cannot be obtained. Thus, the density is not sufficiently high and the maximum pore diameter is as larger as 24 μm. Thus, This is considered to be the reason why rust is produced.

In Comparative Example 33, the content of Cr is as excessive as 29 wt % and the σ phase appears, impeding the sintering. Consequently, rust generation takes place.

In Comparative Example 34, the contents of Cr and Mo are also high, the σ phase appears, impeding the sintering. Consequently, rust generation takes place.

In Comparative Example 35, the content of C is as large as 0.09 wt % and the liquid phase appears, so that a high density sintered product is obtained. However, it is considered that because the content of C is high and the maximum pore diameter is over 20 μm, rust generation takes place.

EXAMPLES 43, 44 AND COMPARATIVE EXAMPLES 36, 37

A starting powder having an average particle size of 8 μm as used in Example 39 was kneaded and molded, followed by removal of the binder in the same manner as in Example 39.

The thus debound molding was heated from room temperature to 1200° C. in vacuum ($10^{-3}$ Torr) and was kept for 1 hour, after which it was maintained for 2 hours after changing to an Ar gas atmosphere at a temperature of 1300° C. (Example 43).

In Example 44, the above procedure was repeated except that the keeping or retention temperature in vacuum was 1100° C. Comparative Examples 40, 41 were the case where the vacuum sintering alone was effected.

These results are shown in Table 15.

In examples 43 and 44, after the vacuum sintering, the molding was sintered in an atmosphere of Ar gas, so that the content of Cr at the surface of the sintered product was not less than 95% of the Cr content in the center of the product. Thus, the sintered products having a good corrosion resistance were obtained.

This is for the reason that the vacuum sintering enables one to attain such contents of C and O that $C \leqq 0.04$ wt %

$O \leqq 0.3$ wt % and the high temperature sintering of not lower than 1300° C. follows, whereupon densification proceeds so that the density ratio becomes not less than 92% and the maximum pore diameter is suppressed to a level of 18 μm, thereby uniformizing the alloy elements.

In Comparative Example 36, since the vacuum sintering temperature used is 1300° C., the contents of C and O are low. However, the Cr content at the surface is 10% of the Cr content in the center of the sintered product for the reason that only the vacuum sintering is performed. As a consequence, the corrosion resistance deteriorates. In Comparative Example 37, the sintering is also the vacuum sintering alone with a low Cr content at the surface. Although the content of C is so high that high densification proceeds by the liquid phase sintering, the corrosion resistance is poor because of the high content of C.

TABLE 14

| No. | Chemical composition of sintered product (wt %) Cr | Mo | C | O | Density ratio (%) | Maximum pore size (μm) | Concentration distribution* | Corrosion resistance |
|---|---|---|---|---|---|---|---|---|
| Example 39 | 13 | — | 0.01 | 0.05 | 95.7 | 17 | Uniform | Good |
| Example 40 | 25 | — | 0.03 | 0.10 | 95.6 | 18 | Uniform | Good |
| Example 41 | 18 | 2.5 | 0.01 | 0.15 | 93.8 | 18 | Uniform | Good |
| Example 42 | 13 | 8.0 | 0.01 | 0.20 | 94.6 | 18 | Uniform | Good |
| Comparative Example 32 | 10 | — | 0.04 | 0.05 | 89.2 | 24 | Uniform | Rust generation |
| Comparative Example 33 | 29 | — | 0.06 | 0.18 | 91.2 | 22 | Uniform | Rust generation |
| Comparative Example 34 | 25 | 12 | 0.07 | 0.25 | 90.2 | 25 | Uniform | Rust generation |
| Comparative Example 35 | 13 | — | 0.09 | 0.10 | 94.2 | 28 | Uniform | Rust generation |

Note) *Sintered product whose Cr concentration at the surface thereof is not less than 80% of the Cr concentration in the inside was evaluated as "uniform", and less than 80% sintered product was evaluated as "non-uniform."

TABLE 15

| No. | Sintering conditions Atmosphere (Temperature °C. × Retention Time) | Density ratio (%) | C (Wt %) | O (Wt %) | Maximum pore diameter (μm) | Concentration distribution* | Corrosion resistance |
|---|---|---|---|---|---|---|---|
| Example 43 | Vacuum (1200 × 1 h) + Ar (1300 × 2 h) | 94.9 | 0.02 | 0.18 | 18 | 95% | Good |
| Example 44 | Vacuum (1100 × 1 h) + Ar (1300 × 2 h) | 96.2 | 0.02 | 0.08 | 18 | 95% | Good |
| Comparative Example 36 | Vacuum (1300 × 3 h) | 94.7 | 0.05 | 0.10 | 20 | 10% | Rust generation |
| Comparative Example 37 | Vacuum (1380 × 1 h) | 96.3 | 0.20 | 0.09 | 32 | 10% | Rust generation |

*Ratio of the Cr concentration at the surface of sintered product to the Cr concentration in the inside As will be seen from the foregoing, the sintered alloy steels of the invention have a good corrosion resistance and good mechanical properties and can be widely used as a material standing use under severe conditions.

These sintered alloy steels can be readily manufactured according to the method of the invention without addition of alloy steel powders other than stainless steel powders, without conducting any re-compression and re-sintering procedure and without resorting to any specific apparatus. In the method of the invention, two-stage sintering is effected including sintering under reduced pressure at a relatively low temperature and subsequent sintering at a relatively high temperature in a non-oxidative atmosphere.

We claim:

1. A method for the manufacture of a corrosion-resistant sintered alloy steel, which comprises providing a stainless steel powder; adding a binder to said steel powder; molding the mixture; and carrying out the steps of (1) heating the resultant molding to remove the binder therefrom, (2) sintering the thus debound molding under reduced pressure up to 30 Torr, and (3) further sintering at a higher temperature than those of steps (1) and (2) in a non-oxidative atmosphere under substantially atmospheric pressure.

2. A method for the manufacture of a corrosion-resistant sintered alloy steel as claimed in claim 1, wherein said step (2) sintering the thus debound molding under reduced pressure up to 30 Torr is carried out at a temperature of 1000°-1350° C.

3. A method for the manufacture of a corrosion-resistant sintered alloy steel as claimed in claim 1, wherein said step (3) further sintering at a higher temperature than those of steps (1) and (2) in a non-oxidative atmosphere under substantially atmospheric pressure is carried out at a temperature of 1250°-1400° C.

4. A method for the manufacture of a corrosion-resistant sintered alloy steel as claimed in claim 1, wherein said non-oxidative atmosphere is an inert-mixed gas atmosphere containing $N_2$.

5. A method according to claim 1, wherein said stainless steel powder has an average particle size of up to 15 μm.

6. A method according to claim 1, wherein a C/O molar ratio in said resultant molding in said step (1) heating the resultant molding to remove the binder therefrom is controlled in the range of 0.3 to 3.0.

7. A method according to claim 1, wherein prior to said step (2) sintering the thus debound molding under reduced pressure up to 30 Torr, a C/O molar ratio in the molding is controlled in the range of 0.3 to 3.0.

8. A method for the manufacture of a corrosion-resistant sintered alloy steel as claimed in claim 1, which comprises providing a stainless steel powder having 16-25 wt % of Cr and 8-24 wt % of Ni, and an average particle size of up to 15 μm; adding a binder to said steel powder; molding the mixture; heating the resultant molding to remove the binder therefrom in a non-oxidative atmosphere; sintering the thus debound molding under reduced pressure up to 30 Torr, at a temperature up to 1350° C.; and further sintering in a non-oxidative atmosphere.

9. A method for the manufacture of a corrosion-resistant sintered alloy steel as claimed in claim 1, which comprises providing a stainless steel powder having 16-25 wt % of Cr and 6-20 wt % of Ni, and an average particle size of up to 15 μm; adding a binder to said steel powder; molding the mixture; heating the resultant molding to remove the binder therefrom in a non-oxidative atmosphere, sintering the thus debound molding under reduced pressure up to 30 Torr, at a temperature up to 1350° C.; and further sintering in an inert mixed gas atmosphere containing $N_2$.

10. A method for the manufacture of a corrosion-resistant sintered alloy steel as claimed in claim 1, which comprises providing a stainless steel powder having 18-28 wt % of Cr and 4-12 wt % of Ni, and an average particle size of up to 15 μm; adding a binder to said steel powder; molding the mixture; heating the resultant molding to remove the binder therefrom in a non-oxidative atmosphere, sintering the thus debound molding under reduced pressure up to 30 Torr, at a temperature up to 1350° C.; and further sintering in a non-oxidative atmosphere.

11. A method for the manufacture of a corrosion-resistant sintered alloy steel as claimed in claim 1, which comprises providing a stainless steel powder having 13-25 wt % of Cr and an average particle size of up to 15 μm; adding a binder to said steel powder; molding the mixture; heating the resultant molding to remove the binder therefrom in a non-oxidative atmosphere; sintering the thus debound molding under reduced pressure up to 30 Torr, at a temperature up to 1350° C.; and further sintering in a non-oxidative atmosphere.

12. A corrosion-resistant sintered alloy steel which comprises a stainless steel composition, said alloy steel having a density ratio of not less than 92%, a maximum diameter of pore present in the structure of not larger than 20 μm, and a content of Cr at the surface of the steel as being sintered which is not less than 80% of a content of Cr in the inside thereof.

* * * * *